US010458215B2

(12) United States Patent
Keller et al.

(10) Patent No.: US 10,458,215 B2
(45) Date of Patent: Oct. 29, 2019

(54) PRODUCING HYDROCARBONS FROM A FORMATION

(71) Applicants: Stuart R Keller, Houston, TX (US); Thomas J. Boone, Calgary (CA); John T. Linderman, Houston, TX (US); Matthew A. Dawson, Sugar Land, TX (US)

(72) Inventors: Stuart R Keller, Houston, TX (US); Thomas J. Boone, Calgary (CA); John T. Linderman, Houston, TX (US); Matthew A. Dawson, Sugar Land, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 346 days.

(21) Appl. No.: 14/761,433

(22) PCT Filed: Jan. 27, 2014

(86) PCT No.: PCT/US2014/013225
§ 371 (c)(1),
(2) Date: Jul. 16, 2015

(87) PCT Pub. No.: WO2014/158333
PCT Pub. Date: Oct. 2, 2014

(65) Prior Publication Data

US 2016/0003017 A1 Jan. 7, 2016

Related U.S. Application Data

(60) Provisional application No. 61/780,028, filed on Mar. 13, 2013.

(51) Int. Cl.
*E21B 43/16* (2006.01)
*E21B 43/26* (2006.01)
*E21B 47/00* (2012.01)

(52) U.S. Cl.
CPC ..... *E21B 43/162* (2013.01); *E21B 43/26* (2013.01); *E21B 47/00* (2013.01)

(58) Field of Classification Search
CPC ..... E21B 43/162; E21B 43/17; E21B 47/00; E21B 43/26
See application file for complete search history.

(56) References Cited

U.S. PATENT DOCUMENTS 3,313,348 A 4/1967 Huitt et al.
5,014,787 A 5/1991 Duerksen
6,481,503 B2 11/2002 Hamilton et al.
(Continued)

*Primary Examiner* — Robert E Fuller
(74) *Attorney, Agent, or Firm* — ExxonMobil Upstream Research Company—Law Department

(57) ABSTRACT

A method for drilling a wellbore in the formation, wherein the wellbore is approximately horizontal; forming two or more fractures in the formation from the wellbore; receiving fracture performance data about the two or more fractures; analyzing the fracture performance data; selecting one or more fractures for injection and selecting one or more fractures for production based on the analysis of the fracture performance data; and completing the wellbore such that injection into the one or more fractures selected for injection and production from the one or more fractures selected for production may occur simultaneously.

19 Claims, 10 Drawing Sheets

(56) References Cited

U.S. PATENT DOCUMENTS

| | | | | |
|---|---|---|---|---|
| 2005/0056418 | A1* | 3/2005 | Nguyen | E21B 43/26 166/250.1 |
| 2008/0210421 | A1* | 9/2008 | Wilson | C09K 8/80 166/254.1 |
| 2010/0096129 | A1 | 4/2010 | Hinkel et al. | |
| 2010/0155065 | A1 | 6/2010 | Misselbrook | |
| 2011/0067870 | A1 | 3/2011 | East, Jr. | |
| 2012/0179379 | A1 | 7/2012 | Alshawaf et al. | |
| 2012/0232859 | A1* | 9/2012 | Pomerantz | G01V 99/005 703/2 |
| 2013/0167628 | A1* | 7/2013 | Hull | G01V 1/001 73/152.58 |
| 2015/0068735 | A1* | 3/2015 | Fowler, Jr. | E21B 43/26 166/250.01 |
| 2015/0369023 | A1* | 12/2015 | MacPhail | E21B 43/12 166/269 |

* cited by examiner

PRODUCING HYDROCARBONS FROM A FORMATION

CROSS-REFERENCE TO RELATED APPLICATION

This application is the National Stage of International Application No. PCT/US2014/013225, filed 27 Jan. 2014, which claims the priority benefit of U.S. Provisional Patent Application 61/780,028 filed 13 Mar. 2013 entitled PRODUCING HYDROCARBONS FROM A FORMATION, the entirety of which is incorporated by reference herein.

BACKGROUND

Fields of Embodiments

The disclosure relates generally to the field of producing hydrocarbons from a formation.

Description of Related Art

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Substantial volumes of hydrocarbons exist in low-permeability and high-permeability formations around the world. Low-permeability formations may be formations that are near horizontal wells with multiple fracture stimulations distributed along the well and required to produce fluids from the formation at economic rates. For example, low-permeability formations may be less than or equal to 10 millidarcies (mD) while high-permeability formations may be formations that are greater than 10 mD. Low-permeability formations may be predominantly sandstone, carbonate, or shale and/or may have some high-permeability streaks. High-permeability formations may have some low-permeability streaks. From a practical perspective low permeability reservoirs may require horizontal wells with one or more hydraulic fracture stimulations to achieve economic production rates while high permeability reservoirs may be economically exploited with vertical or horizontal wells and may not require hydraulic fracture stimulations.

During primary production natural reservoir energy drives hydrocarbons from the reservoir and into the wellbore. Initially, the reservoir pressure is considerably higher than the bottomhole pressure inside the wellbore. This high natural differential pressure drives hydrocarbons toward the well. During primary production the reservoir pressure declines as fluids are removed from the formation. The natural reservoir energy exploited in primary production such as oil and water expansion, evolution and expansion of gas initially dissolved in the oil, and rock compaction have limited ability to compensate for the volume of produced hydrocarbons and thereby to mitigate the pressure decline. As the reservoir pressure declines because of production, so does the differential pressure between the reservoir and wellbore, resulting in declining production rates. Primary production ends when the pressure is so low that the hydrocarbon production rate is no longer economical. Recovery during primary production is typically less than 15%. The lower the permeability of the formation the more difficult it is for pressure and fluid to be transmitted towards the well. This results in lower initial rates, more rapid pressure decline, and lower recovery of hydrocarbons.

Production of hydrocarbons from high-permeability formations often results in more satisfactory recovery rates than low-permeability formations. The recovery rate of hydrocarbons in high-permeability formations can be as high as 75%. To achieve these higher rates, different drive mechanisms may be used. For example, water injection or gas injection may be used to provide pressure support and to displace hydrocarbons. Other processes, such as injecting miscible gases, surfactants, solvents, polymers, or steam may also be used to help improve hydrocarbon recovery.

To increase the recovery rate of hydrocarbons during primary production from low-permeability formations, operators have tried using various well types and configurations, different well stimulation methods and processes that exploit different drive mechanisms during and after primary production. For example, operators have tried closely spaced vertical and horizontal wells, wells that have been stimulated using a variety of methods such as hydraulic fracturing, acid injection or acid fracturing. Stimulation methods increase the productivity of a well, enabling a well to initially produce hydrocarbons at a higher rate. Additionally, operators have tried some of the same drive-mechanisms used in high-permeability formations, such as water-flooding or gas-flooding, after fracturing during primary production. One well design that is commonly employed in low permeability formations, as shown in FIG. 1, consists of installing a horizontal well 1 and creating fractures 2 that emanate from the wellbore 5 of the well 1 to recover the hydrocarbons. As shown in FIG. 2, stimulated horizontal wells can be utilized for water-flooding by a method that entails operators installing a well 100 and injecting water so that the water displaces hydrocarbons toward producer wells 4, 204. Gas-flooding is similar to water-flooding, but entails injecting gas into a well instead of water to displace hydrocarbons to a production well.

Although fracturing can help primary production from a low permeability formation to be more economically attractive by increasing initial production rates, the process has two major disadvantages. First, due to rapid pressure decline in the wellbore region, the production rate of recovered hydrocarbons typically declines quickly to less than 25% of the initial rate of recovery within a year. Second, the total percentage of recovered hydrocarbons relative to the hydrocarbons contained in the formation is low. Often, the total percentage of recovered hydrocarbons is less than 15%. The low formation permeability and resulting low rate of pressure diffusion through the reservoir, results in rapid pressure decline at the well and rapidly declining production rates of hydrocarbons. Furthermore, since primary production processes rely on fluid expansion as their drive mechanisms they tend to have very low recovery levels in all oil reservoirs.

Disadvantages also result when operators use water-flooding or gas-flooding after using fracturing during primary production in a low-permeability formation. These processes have the potential to increase recovery of hydrocarbons to 20% or more. However, they require the drilling and fracturing of additional injection wells or the conversion of existing production wells into injection wells. Because of the low permeability, the injection wells need to be relatively close to the producing well to provide sufficient pressure support and achieve economic rates. Nonetheless, water-flooding in low-permeability formations is often limited by low injection rates due to the low-permeability formation, injection pressure constraints, plugging, separation between the wells and relative permeability effects. A key limiting factor is that if the injection wells are placed in close proximity to the production wells, the fractures from the wells may intersect. This results in high conductivity pathways between the wells that severely limit the rate of hydrocarbon production and the overall recovery that can be economically achieved. Gas-flooding in low-permeability formations is often limited by poor sweep due to gravity override, viscous fingering and heterogeneity contrast. These detrimental effects often cause fractures to intersect, thereby eliminating the pressure difference needed for sweep to occur. These disadvantages are often exacerbated in low-permeability formations because of tight well spacing and higher permeability streaks.

Additional disadvantages may also result when the aforementioned drive mechanisms are used in low-permeability or high-permeability formations. The effectiveness of water injection for improved recovery is sometimes adversely affected by reduced injectivity due to plugging of injection wells with solids, scale, oil, etc. Enhanced recovery techniques, such as injection of miscible gases, surfactants, solvents, polymers, modified brines, or steam can sometimes be applied to high permeability reservoirs to improve recovery, but the use of these techniques is often uneconomic. There is a significant time difference between when these relatively expensive fluids are injected into an injection well when that incremental hydrocarbon production occurs at a producing well.

A need exists for improved technology, including technology that may address one or more of the above described disadvantages of conventional ways of producing hydrocarbons from a formation.

SUMMARY

A method of producing hydrocarbons from a formation may include drilling a wellbore in the formation, wherein the wellbore is approximately horizontal; forming two or more fractures in the formation from the wellbore; receiving fracture performance data about the two or more fractures; analyzing the fracture performance data; selecting one or more fractures for injection and selecting one or more fractures for production based on the analysis of the fracture performance data; and completing the wellbore such that injection into the one or more fractures selected for injection and production from the one or more fractures selected for production may occur simultaneously.

A method of producing hydrocarbons from a formation may include drilling a wellbore in a formation; forming a first fracture in the formation that emanates from the wellbore; forming a second fracture in the formation that emanates from the wellbore and is substantially parallel to the first fracture; and simultaneously (a) injecting a fluid, that increases pressure in an area of the formation adjacent to the first fracture, from an injection tubing string in communication with the second fracture and (b) producing hydrocarbons from the first fracture into a production tubing string that is substantially parallel to the injection tubing string. The wellbore is approximately horizontal.

A method of producing hydrocarbons from a formation may include drilling a first wellbore in a formation, wherein the first wellbore is approximately horizontal; forming a first fracture in the formation that emanates from the first wellbore; forming a second fracture in the formation that emanates from the first wellbore and is substantially parallel to the first fracture; sealing an opening to one of the first fracture and the second fracture with a sealing element; drilling a second wellbore in the formation that is approximately horizontal and substantially parallel to the first wellbore, wherein the second wellbore intersects the first fracture and the second fracture; and simultaneously (a) injecting a fluid, that increases pressure in an area of the formation adjacent to the first fracture, from the second wellbore to the second fracture and (b) producing hydrocarbons that travel from the first fracture into the first wellbore.

A method of producing hydrocarbons from a formation may include drilling a first wellbore in a formation, wherein the first wellbore is approximately horizontal; forming a first fracture in the formation that emanates from the first wellbore; drilling a second wellbore in the formation that is approximately horizontal and substantially parallel to the first wellbore; forming a second fracture in the formation that emanates from the second wellbore and is substantially parallel to the first fracture, wherein the first fracture intersects the second wellbore and the second fracture intersects the first wellbore; and simultaneously (a) injecting a fluid, that increases pressure in an area of the formation adjacent to the first fracture, from the second wellbore to the second fracture and (b) producing hydrocarbons that travel from the first fracture into the first wellbore.

A system for producing hydrocarbons from a formation may include an approximately horizontal wellbore in a formation, the wellbore including an injection tubing string and a production tubing string that is substantially parallel to the injection tubing string; a first fracture in the formation that emanates from the wellbore; a second fracture in the formation that emanates from the wellbore and that is substantially parallel to the first fracture; wherein the second fracture is constructed and arranged to receive a fluid injected into the injection tubing string that increases pressure in the formation in an area adjacent to the first fracture, and wherein the first fracture is constructed and arranged to receive hydrocarbons when the second fracture receives the fluid.

The foregoing has broadly outlined some of the features of the present disclosure in order that the detailed description that follows may be better understood. Additional features will also be described herein.

BRIEF DESCRIPTION OF THE DRAWINGS

These and other features, aspects and advantages of the disclosure will become apparent from the following description, appending claims and the accompanying exemplary features shown in the drawings, which are briefly described below.

Figure 1:
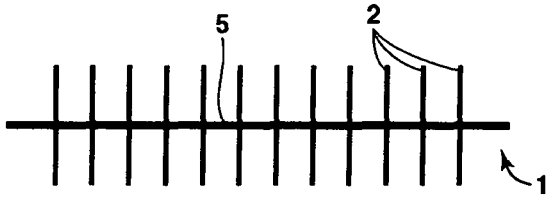
FIG. 1 (Prior Art)
FIG. 1 is a top, schematic view of a conventional well.
Figure 2:
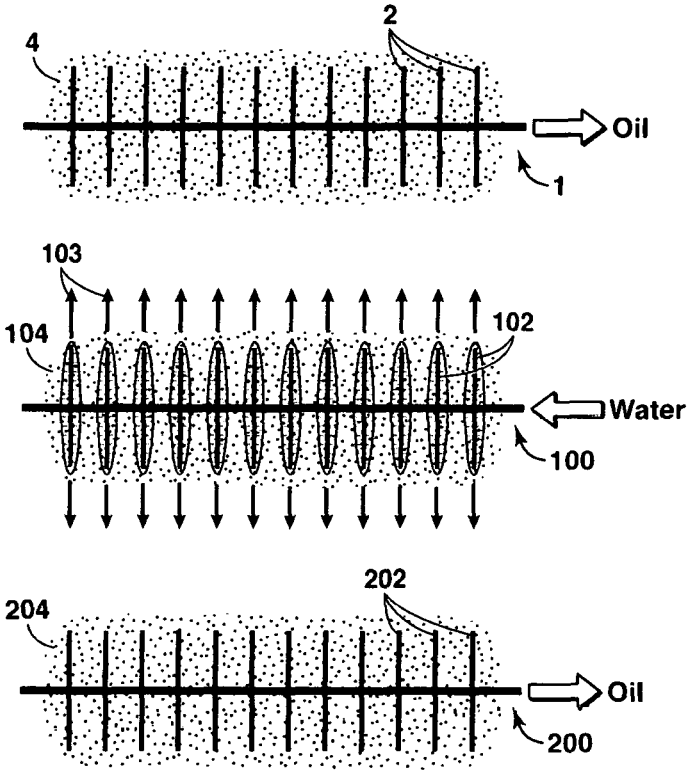
FIG. 2 (Prior Art)
FIG. 2 is a top, schematic view of conventional production well and a conventional injection well.
Figure 3:
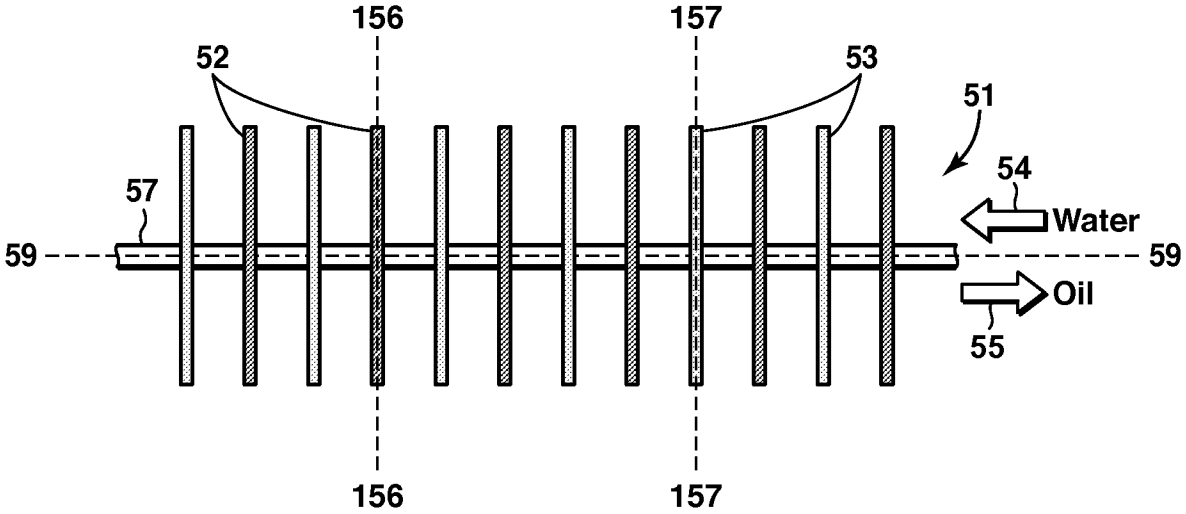
FIG. 3 is a top, schematic view of a well.

It should be noted that the figures are merely examples of several embodiments of the present disclosure and no limitations on the scope of the present disclosure are intended thereby. Moreover, not all features of an embodiment may be shown in the figures. Further, the figures are generally not drawn to scale, but are drafted for purposes of convenience and clarity in illustrating various aspects of certain embodiments of the disclosure.

DETAILED DESCRIPTION

For the purpose of promoting an understanding of the principles of the disclosure, reference will now be made to the information illustrated in the drawings and specific language will be used to describe the same. It will nevertheless be understood that no limitation of the scope of the disclosure is thereby intended. Any alterations and further modifications in the described embodiments, and any further applications of the principles of the disclosure as described herein are contemplated as would normally occur to one skilled in the art to which the disclosure relates. It will be apparent to those skilled in the relevant art that some features that are not relevant to the present disclosure may not be shown in the figures for the sake of clarity.

As shown in FIGS. 3-6, a system of producing hydrocarbons from a formation may include an approximately horizontal wellbore 57, 67, 76, 84, a first fracture 52 and a second fracture 53.

The approximately horizontal wellbore 57, 67, 76, 84 may be a wellbore that is at a high angle or a dipping angle, but not completely horizontal, or a wellbore that is substantially horizontal.

The wellbore 57, 67, 76, 84 is a hole that may be open, lined with a liner or casing 60, 70, within the formation having a reservoir 51, 61, 71, 81 (FIGS. 3-6). The formation may be a low-permeability formation or a high-permeability formation. Practically speaking, low-permeability formations may be formations where near approximately horizontal wells are employed with multiple fracture stimulations distributed along the well and required to produce fluids from the formation at economic rates. For example, a low-permeability formation may be less than or equal to 10's of mD, 10's of mD on average, 10 mD, or 10 mD on average. Low-permeability formations may have some high-permeability streaks and high-permeability formations may have some low-permeability streaks.

The permeability of a formation may be measured by any suitable method. For example, the permeability may be measured or determined from core tests or well tests. The average permeability of a formation may be based on a thickness-weighted arithmetic average of measured or estimated permeabilities within the formation, or it may be based on well test measurements. Furthermore, it is recognized that permeability can vary greatly from place to place within a given reservoir and there may not be consistency between different measures of permeability.

The wellbore 57, 67, 76, 84 may comprise a single wellbore. In other words, the wellbore 57, 67, 76, 84 may comprise one wellbore. The single or one wellbore may be within one or more formations having one or more reservoirs.

Figure 4:
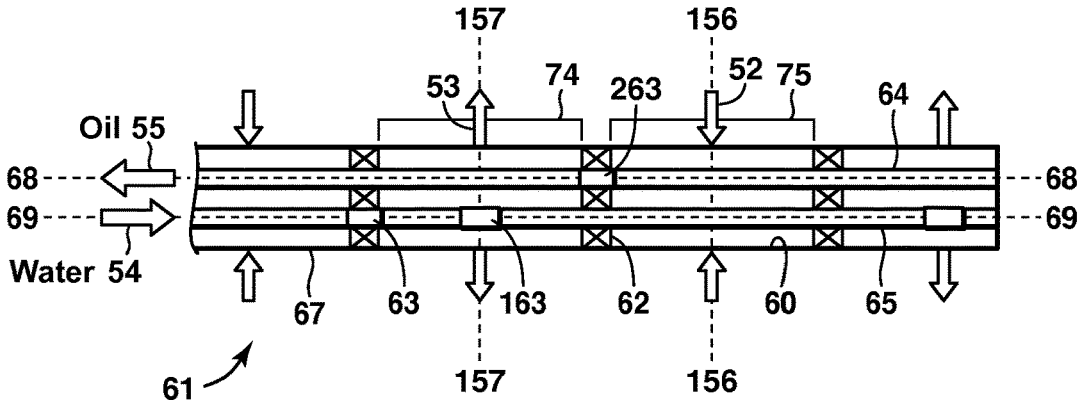
FIG. 4 is a top, schematic view of a well.
Figure 5:
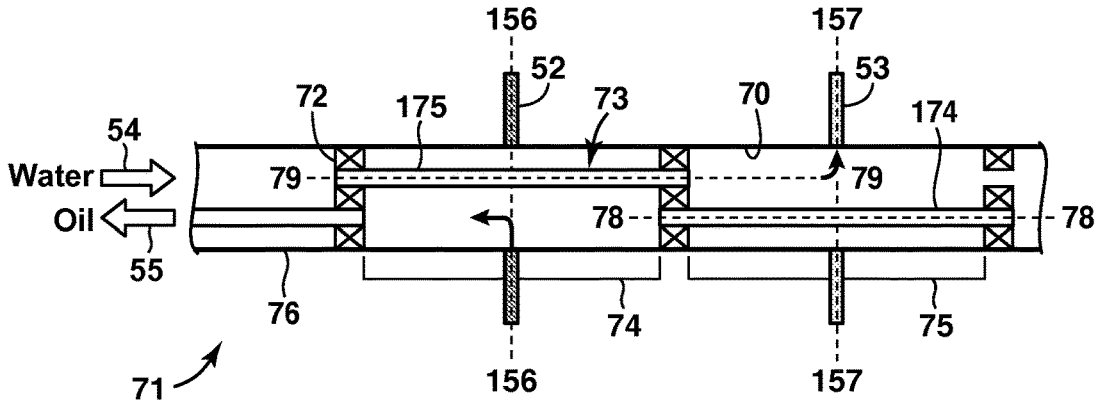
FIG. 5 is a top, schematic view of a well.
Figure 6:
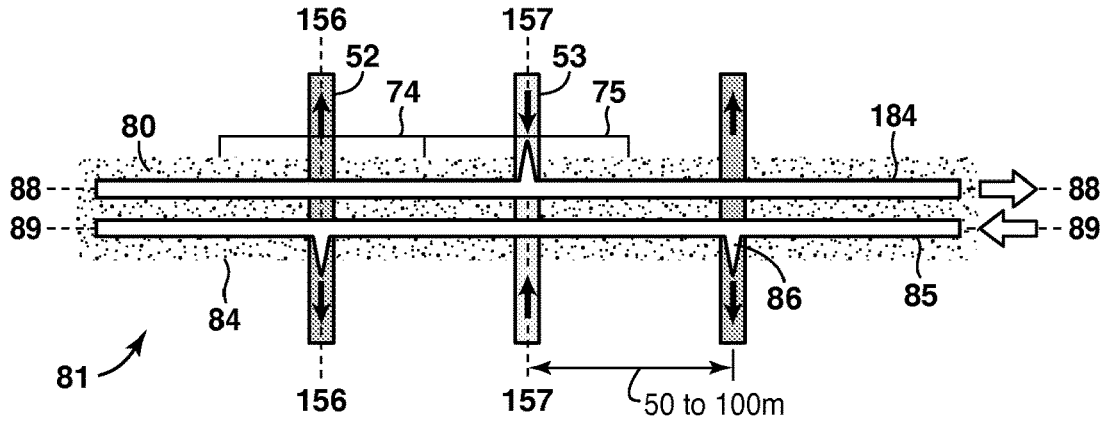
FIG. 6 is a top, schematic view of a well.
Figure 7:
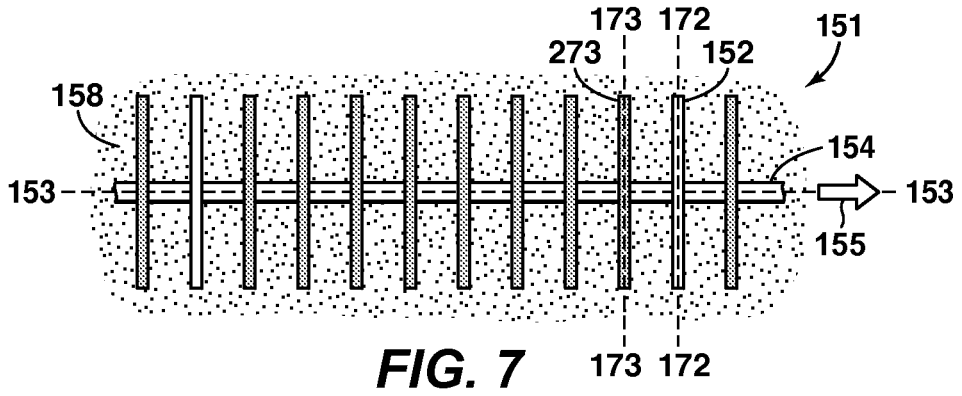
FIG. 7 is a top, schematic view of a first well during primary production.
Figure 8:
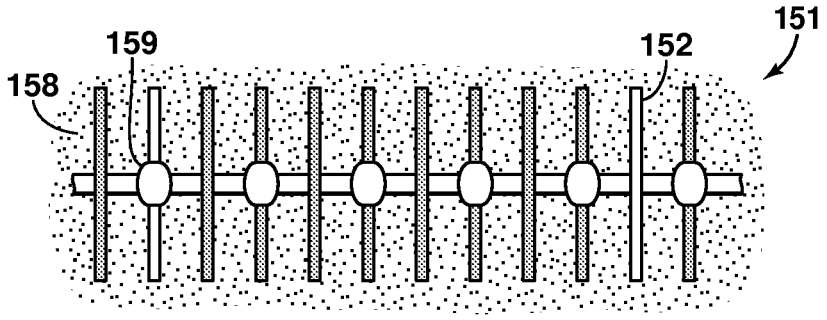
FIG. 8 is a top, schematic view of the first well of FIG. 7 after fractures in the first well have been sealed.
Figure 9:
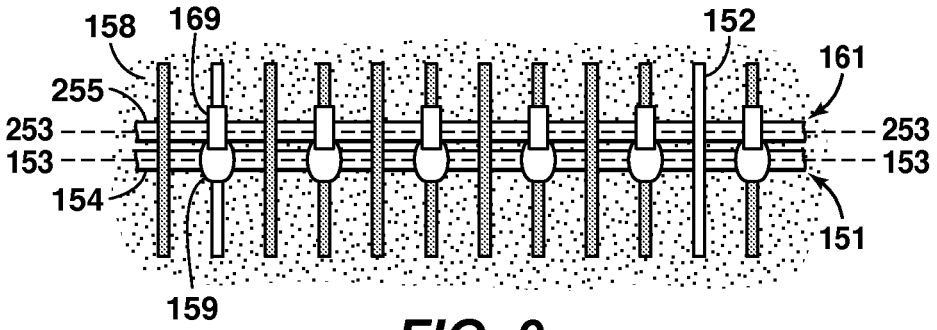
FIG. 9 is a top, schematic view of the first well of FIG. 7 and a second well after the fractures in the first well have been sealed.

The wellbore 57, 67, 76, 84 may include an injection tubing string 65, 175, 85 and a production tubing string 64, 174, 184 (FIGS. 3-6). The injection tubing string 65, 175, 85 may be substantially parallel to the production tubing string 65, 175, 85 such that an injection tubing string longitudinal axis 69-69, 79-79, 89-89 (FIGS. 4-6) of the injection tubing string 65, 175, 85 is substantially parallel to a production tubing string longitudinal axis 68-68, 78-78, 88-88 of the production tubing string 64, 174, 184 (FIGS. 4-6). The production tubing string longitudinal axis 69-69, 79-79, 89-89 and injection tubing string longitudinal axis 68-68, 78-78, 88-88 are substantially parallel to a longitudinal axis 59-59 (FIG. 3) of the wellbore 57, 67, 76, 84.

The injection tubing string 65 includes at least one opening. The opening may be constructed and arranged to inject fluid into the second fracture 53 (FIG. 4). The opening creates a pathway between the injection tubing string 63 and the second fracture 53 so that the second fracture 53 can receive the fluid from the injection tubing string 63. The opening may be any suitable opening, such as a perforation.

As shown in FIGS. 4 and 6, the injection tubing string 65, 85 may be directly adjacent to the production tubing string 64, 184 and may be the same length or about the same length as the production tubing string 64, 184. Moreover, the injection tubing string 65, 85 and the production tubing string 64, 184 may both extend through a production zone and an injection zone 74 of the wellbore 67, 84. The production zone 75 is the zone in the well 75 that directly communicates with the portion of the formation that receives hydrocarbons from the reservoir and the injection zone 74 is the zone in the well that directly communicates with the portion of the formation that receives fluid injected into the wellbore from the reservoir.

As shown in FIGS. 4 and 5, the production zone 75 is separated or isolated from the injection zone 74. The production zone 75 may be hydraulically separated or isolated from the injection zone 74 by any suitable device, such as a packer 62 (FIGS. 4 and 5) or cement (FIG. 6). The packer 62 may be any suitable packer. For example, the packer 62 may be a single packer, such as a hydraulically set single packer, or a dual-string packer, such as a hydraulically set dual-string packer. The packer may be in an open hole, in a casing or liner, or external to a casing or liner. The cement may be external to a casing or liner.

An injection tubing string flow control device 63 may be used to assist in setting the packer 62 in the wellbore and/or to regulate fluid flow into and/or out of the second fracture 53. As shown in FIG. 4, the fluid may be discontinuously injected from the injection tubing string 65 to the second fracture 53 with the flow control device 63, 163. Specifically, the injection tubing string flow control device 63, 163 may be constructed and arranged to discontinuously create a pathway between the injection tubing string 65 and the second fracture 53. For example, the injection tubing string flow control device 63, 163 may not cover or cover the opening in the injection tubing string. When the injection tubing string flow control device is open, a fluid pathway exists between the injection tubing string 65 and the second fracture 53. When the injection tubing string flow control device is closed, a fluid pathway does not exist between the injection tubing string 65 and the second fracture 53. As a result, fluid injected into the injection tubing string 65 may only enter the second fracture 53 when the injection tubing string flow control device is open.

The injection tubing string flow control device 63, 163 may comprise any suitable mechanism. For example, the injection tubing string flow control device 63, 163 may comprise one of a sliding sleeve, a pressure activated valve, a mechanically activated valve, an electrically activated valve, an inflow control device, an outflow control device, a choke and a limited-entry perforation. When the injection tubing string flow control device assists in setting the packer, the injection tubing string flow control device may not be an inflow control device or an outflow control device.

The injection tubing string flow control device 63, 163 may enclose a portion of the injection tubing string 65. The injection tubing string flow control device 63, 163, may be a separate element from the injection tubing string 65. The injection tubing string flow device 63, 163 may be part of the injection tubing string 65.

A portion of the production tubing string 64 may be enclosed by a production tubing string flow control device or the production tubing string may include a production tubing string flow control device 263 (FIG. 4). The production tubing string flow control device may discontinuously create a pathway between the production tubing string 64 and the first fracture 52 so that the production tubing string discontinuously receives hydrocarbons from the first fracture 52. The production tubing string flow control device may help to gain additional flexibility as it pertains to producing hydrocarbons from the first fracture 52. The production tubing string flow control device 263 may function the same way that the injection tubing string flow control device functions. The production tubing string flow control device may be any suitable element, such as a sliding sleeve, a pressure activated valve, a mechanically activated valve, an electrically activated valve, an inflow control device, an outflow control device, a choke and a limited-entry perforation.

The production tubing string 64 may include at least one opening. The opening may be constructed and arranged to receive the hydrocarbons from the first fracture 52 (FIG. 4). The opening creates a pathway between the production tubing string 64 and the first fracture 52 so that the production tubing string 64 can receive hydrocarbons from the first fracture 52. The opening may be any suitable opening, such as a perforation.

The injection tubing string 65, 175 and the production tubing string 64, 174 may be housed within a liner 60, 70 (FIGS. 4-5). The liner 60, 70 may be made out of any suitable material, such as steel and/or cement. Alternatively, the injection tubing string 85 and the production tubing string 184 may be encased (e.g., completely surrounded) within cement, grout, epoxy or another similar material by an encasement (FIG. 6).

When the injection tubing string 85 and the production tubing string 184 are housed within the encasement of cement, grout, epoxy or another similar material, such as shown in FIG. 6, a portion of the injection tubing string 85 may not be enclosed by a flow control device or include a flow control device and a packer may not be needed to separate the injection zone 74 from the production zone 75. The injection tubing string 85 and the production tubing string 184 may each include an opening 86. The openings 86 allow the injection tubing string 85 to communicate with the second fracture 53 that receives the fluid and allow the production tubing string 184 to communicate with the first fracture 52 (FIG. 6). Moreover, the opening 86 in the production tubing string 184 receives the hydrocarbons from the first fracture 52 and the opening in the injection tubing string 85 receives the fluids injected into the second fracture 53. When the injection tubing string 85 and the production tubing string 184 are encased by the encasement, the cost of creating the system may be less than that of an injection tubing string and a production tubing string housed within a liner, such as in FIGS. 4 and 6. The opening 86 may be any suitable opening, such as a perforation.

As shown in FIG. 5, the injection tubing string 175 and the production tubing string 174 may be interspersed throughout the wellbore 76 such that the production tubing string 174 only extends through the injection zone 75 of the wellbore 76 and not the production zone 74 of the wellbore 76 and the injection tubing string 175 only extends through the production zone 74 of the wellbore 76 and not the injection zone 75 of the wellbore 76. In other words, the tubing strings 174, 175 in the wellbore 76 may comprise jumper tubing strings. When this occurs, the production tubing string 174 communicates with the second fracture 53 and the injection tubing string 175 communicates with the first fracture 52.

When the injection tubing string 175 and the production tubing string 174 are interspersed throughout the wellbore 76 (FIG. 5), the wellbore 76 may include a packer 72 and/or the injection tubing string 175 and production tubing string 174 may be housed within the liner 70 (FIG. 5). The packer 72 may separate the production zone from the injection zone. The packer 72 may be any suitable packer. For example, the packer 72 may be a single packer, such as a hydraulically set single packer, or a dual-string packer, such as a hydraulically set dual-string packer. The packer may be in an open hole, in a casing or liner, or external to a casing or liner. Instead of a packer, the wellbore 76 may include cement. The cement may be external to a casing or liner.

The interspersed nature of the injection tubing string 175 and the production tubing string 174 allow for the liner 70 to be smaller than the liner 60 of FIG. 5, but may expose the liner 70 to the fluid or the hydrocarbons and pressure. Moreover, the interspersed nature allows for less flexibility to control the inflow and outflow of the fluid and the hydrocarbons, respectively, than that of the configuration shown in FIG. 5.

The first fracture 52 in the system is in the formation and emanates from the wellbore 57, 67, 76, 84 (FIGS. 3-6). The first fracture 52 is formed by any suitable type of fracturing. For example, the first fracture 52 may be formed by a hydraulic fracturing treatment with or without proppant, or with acid injection. The first fracture 52 may be any suitable size. The first fracture 52 may receive hydrocarbons from a reservoir in the formation.

The first fracture 52 is constructed and arranged to receive hydrocarbons when the second fracture 53 receives a fluid injected into the wellbore. In other words, the first fracture 52 is sized and located to receive hydrocarbons from a reservoir in the formation. The first fracture 52 is in fluid communication with a tubing string that receives the hydrocarbons (i.e., the production tubing string) so that this tubing string can receive the hydrocarbons that the first fracture 52 receives and, therefore, produces.

The fluid injected into the wellbore may be any suitable fluid. For example, the fluid may comprise at least one of water, a hydrocarbon gas, a non-condensable gas, surfactants, foaming agents, polymers, and solids. If the fluid comprises a gas, the gas may be a miscible gas. The water may comprise any type/form of water. For example, the water may comprise at least one of modified brine, hot water, cold water and steam. The non-condensable gas may comprise any type of non-condensable gas. For example, the non-condensable gas may comprise at least one of carbon dioxide, methane, ethane, propane, and nitrogen gas.

Before or after injecting the fluid, a plugging agent may be injected into the wellbore to promote diversion of the fluid away from any high-permeability streaks in a low-permeability formation, any low-permeability streaks in a high-permeability formation, and/or other short-circuit paths so better displacement is obtained. The plugging agent may be any suitable plugging agent, such as at least one of cement, polymer, foam, gel, or gel forming chemical. The gel forming chemical may be any suitable chemical, such as at least one of sodium silicate solution, solid, or salt. The plugging agent may be injected into at least one of the first fracture 52 and the second fracture.

A casing and/or liner patch may be installed in the wellbore. The casing or liner patch promotes diversion of the fluid away from any section of the wellbore that is connected to the reservoir to block flow into regions of the reservoir having high permeability paths and/or other short-circuit paths so better displacement is obtained elsewhere in the reservoir. The casing and/or liner patch may be installed into at least one of the first fracture 52 and the second fracture 53. The casing or liner patch may be installed into the wellbore after a period of operation and/or a production log identifying excessive flow.

The second fracture 53 is in the formation and emanates from the wellbore 57, 67, 76, 84 (FIGS. 3-6). The second fracture 53 is formed by any suitable type of fracturing. For example, the second fracture 53 may be formed by a hydraulic fracturing treatment with or without proppant, or with acid injection. The second fracture 53 may be any suitable size. The second fracture 53 may comprise an injection fracture that receives the fluid.

The second fracture 53 is constructed and arranged to receive the fluid injected into the injection tubing string 65, 175, 85 (FIGS. 4-6) that increases pressure in the formation in an area adjacent to the first fracture 52. In other words, the second fracture 53 is sized to receive the fluid and is in fluid communication with the injection tubing string that receives the fluid when the fluid is injected into the wellbore so that the second fracture 53 can receive the fluid from the injection tubing string.

When the fluid injected into the second fracture 53 increases pressure in the formation in an area adjacent to the first fracture 52, hydrocarbons are displaced from the first fracture 52 and are produced by the first fracture 52. In other words, when the fluid injected into the second fracture 53 increases pressure, the hydrocarbons travel into the first fracture 52 and from the first fracture 52 into the production tubing string. The hydrocarbons are displaced in-part because the injection of the fluid creates a pressure difference between the area surrounding the first fracture and the area surrounding the second fracture that leads to hydrocarbons entering the first fracture. The hydrocarbons are also displaced because the first fracture and the second fracture do not intersect. If the first fracture intersects the second fracture, the efficiency of the process is reduced due to the high permeability pathway that results allowing the injected fluids to flow directly to the first fracture 52 without displacing the targeted hydrocarbons in the reservoir. Provided that the locations of the fractures is controlled such that the fractures are initiated at a spacing of 10's of meters or more along the well, the fractures would not be expected to intersect.

The first fracture 52 may comprise a plurality of first fractures and the second fracture 53 may comprise a plurality of second fractures. Each of the plurality of first fractures may be directly adjacent to one of the plurality of second fractures so that the first and second fractures alternate along a length of the wellbore. Each first fracture 52 may be about 25 to 300 m or 100 to 200 m from each second fracture 53. This spacing between the first fracture 52 and the second fracture 53 may depend on the permeability of the formation, formation heterogeneities, completion costs, risk of fracture intersection, etc. Each first fracture 52 may not be used for production. Each second fracture 53 may not be used for injection. Alternatively, some of the plurality of first fractures may be directly adjacent to each other to form a first fracture group and some of the plurality of second fractures may be directly adjacent to each other to form a second fracture group. Each fracture may be about 25 to 300 m apart, such as between 100 to 200 m apart. The first fracture group may be directly adjacent to a second fracture group. There may be a plurality of first and/or second fracture groups. Not all of the first and/or second fracture groups may be used for production and injection, respectively.

The first fracture 52 and the second fracture 53 may extend from the wellbore 57, 67, 76, 84 for any suitable distance. For example, the first fracture 52 and the second fracture 53 may extend from the wellbore 57, 67, 76, 84 for 20 to 500 m or 100 to 300 m. The length of the wellbore extends along the longitudinal axis 59-59 of the wellbore.

At least one of the first fracture 52 and the second fracture 53 may comprise one of a propped fracture, an unpropped fracture and an acid fracture. When the first and/or second fracture 52, 53 comprise a propped fracture, the first and/or second fracture 52, 53 include a material that props the fracture 52, 53 open during and after fracturing so that a fluid path between the fracture 52, 53 and the wellbore remains open. The material may comprise sized particles that are mixed with the fluid used to create the fracture 52, 53. The sized particles may include sand grains, proppants or any other suitable sized particles. When the first and/or second fractures 52/53 comprise an unpropped fracture, the first and/or second fractures 52/53 remain propped because of the natural properties of the formation after fracturing. When the first and/or second fracture 52, 53 comprise an acid fracture, the first and/or second fracture 52, 53 may be fractured with an acid. The acid may be any suitable acid, such as a hydrochloric acid. The acid fracture may be used in carbonate formations where it's practical to dissolve the rock in the formation with an acid. Propped fractures may be applied in most types of reservoirs, including both carbonate and clastics (e.g. sandstone, shale).

The injected fluid may enter the reservoir at a high enough pressure to hydraulically fracture the reservoir during the process of fluid injection and production. In this mode of operation one may not have performed a fracture treatment of any form previously discussed.

The first fracture 52 may comprise one type of fracture, such as a hydraulic fracture, and the second fracture 53 may comprise another type of fracture, such as an acid fracture. When the fractures comprise different types of fractures, one type of fracture may have to be produced at a first time and the other type of fracture may have to be produced at a second time that is different from the first time. For example, the first fracture 52 may have to be produced at the first time and the second fracture 53 may have to be produced at the second time. Alternatively, the different types of fractures may be produced at the same time.

The first fracture 52 may include a first fracture longitudinal axis 156-156 and the second fracture may include a second fracture longitudinal axis 157-157 (FIGS. 4-6). The first fracture longitudinal axis 156-156 may be substantially parallel to the second fracture longitudinal axis 157-157 such that the first fracture 52 is substantially parallel to the second fracture 53. The first and second fracture longitudinal axes 156-156, 157-157 may be substantially transverse to the longitudinal axis 59-59 of the wellbore 57, 67, 76, 84 (FIGS. 3-6). In other words, at least one of first fracture 52 and the second fracture 53 may be substantially oblique and/or irregular with respect to the wellbore.

Figure 13:
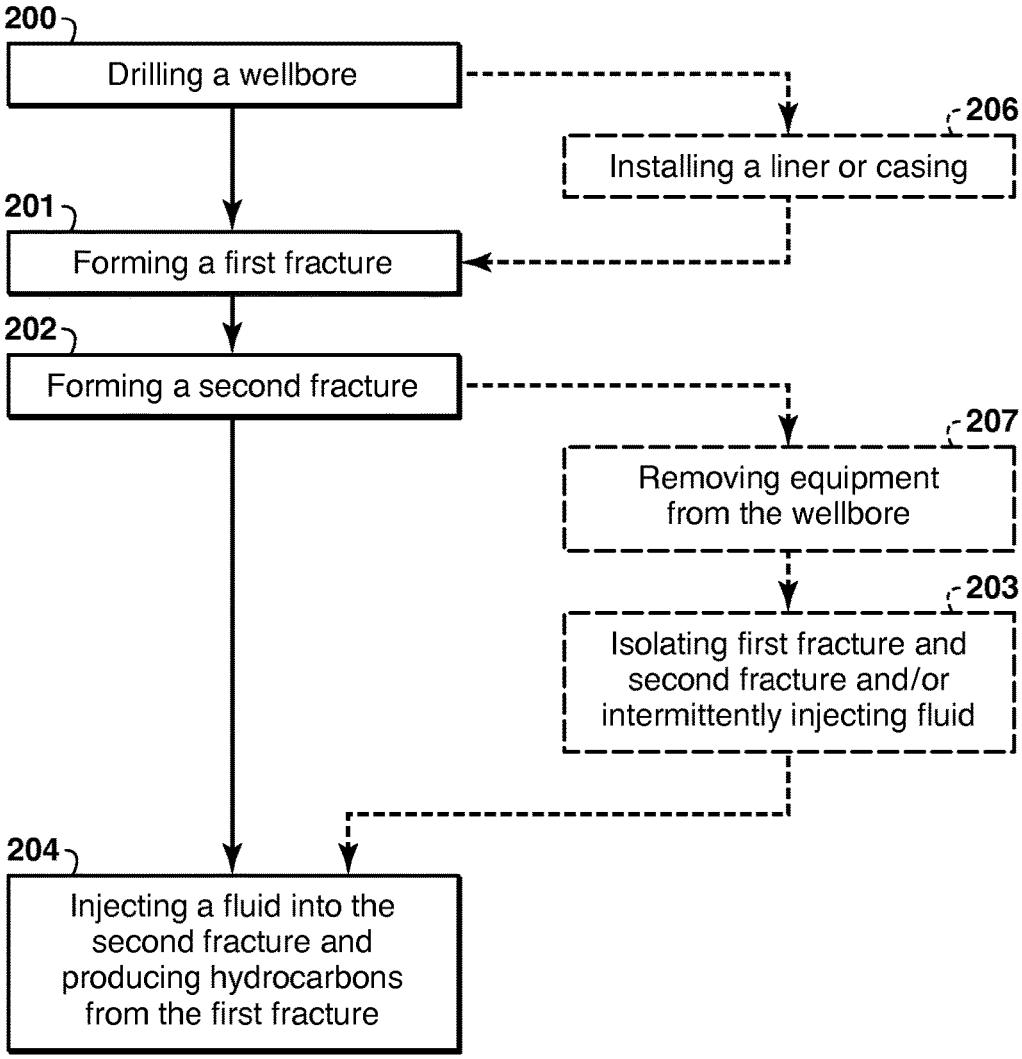
FIG. 13 is a schematic of a method of producing hydrocarbons from a formation.

As shown in FIG. 13, a method of producing hydrocarbons from a formation may include drilling the wellbore in the formation 200, forming the first fracture 52 that emanates from the wellbore 57, 67, 76, 84, 201, forming the second fracture 53, 202 that emanates from the wellbore 57, 67, 76, 84 and is substantially parallel to the first fracture 52, 202, and simultaneously (a) injecting the fluid from the injection tubing string in communication with the second fracture 53 and (b) producing the hydrocarbons 204 that travel from the first fracture 52 into the production tubing string. This method of producing hydrocarbons from a formation is the method of producing hydrocarbons for the system previously discussed and, therefore, previously discussed elements will not be described again in detail.

Simultaneously is defined as occurring at the same time or almost occurring at the same time such that there is not a significant time lag between when the fluid is injected and the hydrocarbons are produced. While the injection and production generally occur simultaneously, there may be instances where injection occurs without production and/or production occurs without injection. Injection and production may not occur at the same time to manage excessive communication between the injection tubing string, the production tubing string, the first fracture, and/or the second fracture.

The wellbore may be drilled by any suitable mechanism and the wellbore may be approximately horizontal when the wellbore is drilled. Specifically, the orientation of the wellbore may be approximately parallel relative to the Earth's surface. The longitudinal axis 59-59 of the wellbore 57, 67, 76, 84 may be approximately parallel to the lateral axis of the Earth and approximately transverse to the longitudinal axis of the Earth.

The fluid is injected from the injection tubing string 65, 175, 85 to the second fracture 53 and the hydrocarbons are produced from a reservoir communicating with the first fracture 52 to the production tubing string 64, 174, 84 that is substantially parallel to the injection tubing string 65, 75, 85, simultaneously. As previously discussed, the injection of the fluid into the second fracture 53 increases pressure in an area of the formation adjacent to the first fracture 52.

The fluid may be discontinuously injected 203 from the injection tubing string 65 (FIG. 4) to the second fracture 53 with the flow control device 63, 163 and/or fluid/hydrocarbons may be discontinuously injected from the production tubing string 64 by the flow control device 263 (FIG. 4). At least paragraphs [0046]-[0048] of the disclosure provides examples of what the flow control device 63, 16, 263 may comprise and how the fluid may be discontinuously injected from the injection tubing string 65 and/or the production tubing string 64.

Regardless of whether the flow control device 63, 163, 263 is a separate element from the injection tubing string 65 and/or the production tubing string 64 or part of the injection tubing string 65 and/or the production tubing string 64, the flow control device 63, 163, 263 forms a complete or partial enclosure around the opening of the injection tubing string 65 and/or the production tubing string 64 that may be constructed and arranged to receive a fluid from the second fracture 53 and/or hydrocarbons from the first fracture 52. When the flow control device 63, 163, 263 forms a complete enclosure, the flow control device 63, 163, 263 surrounds the entire circumference of a portion of the injection tubing string 65 and/or the production tubing string 64. When the flow control device 63, 163, 263 forms a partial enclosure, the flow control device 63, 163, 263 surrounds less than the entire circumference of a portion of the injection tubing string and/or the production tubing string 64. When the flow control device 63, 163, 263 is in an open position, there is a continuous fluid pathway between the opening and the second fracture 53 and/or the first fracture 52 so that the fluid can be injected into the second fracture 53 and/or hydrocarbons can be received from the first fracture 52. When the flow control device 63, 163, 263 is in a closed position, there is no pathway between the opening and the second fracture 53 and/or the first fracture 52 so that the fluid cannot be injected into the second fracture 53, unwanted fluid or hydrocarbons cannot enter the injection tubing string from the wellbore, hydrocarbons cannot be injected into the production tubing string 64, and/or unwanted fluid or hydrocarbons cannot enter the production tubing string from the wellbore. In other words, the closed flow control device 63, 163, 263 prevents fluid and/or hydrocarbons from exiting or entering the opening of the injection tubing string 65 and/or the production tubing string 64.

The method may also include isolating 203 the first fracture 52 from the second fracture 53. The first fracture 52 may be isolated from the second fracture by the packer 62, 72 (FIGS. 43-5). The packer 62, 72 may be installed in the wellbore 67, 76 after forming the first fracture 52 and the second fracture 53 and/or before simultaneously injecting the fluid and producing the hydrocarbons 204. While this disclosure references using one packer 62, 72, multiple packers 62, 72 may be used. Likewise, multiple flow control devices may be used.

Additionally, the method may include removing equipment 207 from the wellbore 57, 67, 76, 84 before isolating the first fracture 52 from the second fracture 53 and/or before discontinuously injecting the fluid 203. The method may include removing the equipment when the mechanism for forming the first fracture 52 and/or the second fracture 53 results in leaving equipment in the wellbore. When such a mechanism is used, the equipment must be removed before installing the packer 62, 72 and/or the flow control device 63, 163 that isolate the fractures 52, 53 and discontinuously injecting/receiving the fluid/hydrocarbons. Any suitable mechanism may be used to remove the equipment. For example, the equipment may be removed by using milling equipment to mill-out the equipment.

The method may also include installing the liner 60, 70 (FIGS. 4-5) or encasing with the encasement (FIG. 6) 206. The installation or encasing may occur before forming the fracture 52, 53. The installation or encasing may occur after drilling the wellbore 200.

Before simultaneously (a) injecting the fluid and (b) producing the hydrocarbons 204, hydrocarbons may first be produced from at least one of the first fracture and the second fracture. The hydrocarbons may first be produced during primary production. Primary production may occur until the rate of recovery of hydrocarbons has declined substantially from the peak rate of recovery. After the substantial decline, the simultaneous injection of fluid and production of hydrocarbons 204 may occur. This sequence of events (i.e., first using primary production and then using simultaneous injection of fluid and production of hydrocarbons) may minimize the amount of capital investment risked and may work particularly well in low-permeability formations where the initial rate of recovery is relatively high, but significantly declines during the first year that the well is operated.

To further reduce the initial capital costs, the completion elements, such as the packer and/or flow control device, may be installed in the wellbore after the well has produced under primary production. This ensures that the installation of the completion elements does not affect the amount of hydrocarbons produced during primary recovery. If the completion elements are installed after primary production, a rig or other mechanism may have to be used to aid in installation. If problems occur while simultaneously injecting and producing, injection could be stopped and only production commenced or the problematic injection fracture(s) 53 could be closed off by plugging, closing the flow control device, etc.

Alternatively, hydrocarbons may initially be produced by simultaneously injecting fluid and producing hydrocarbons as opposed to initially producing hydrocarbons by primary production and then later switching to simultaneously injecting fluid and producing hydrocarbons.

Two or more simultaneous injection-production wells may be drilled and completed in a reservoir approximately parallel to each other. After at least one of these wells has produced under simultaneous injection and production for a prolonged period and hydrocarbon recovery rate has declined significantly due to an increasing fraction of water or gas in the produced fluids, injection may be stopped in at least one of the wells and production may be stopped in at least one of the wells adjacent to the at least one of the wells where injection is stopped. This will allow water, gas or other injected fluids to displace hydrocarbons from the area between the adjacent wells to the producing well, thereby increasing hydrocarbon recovery.

Figure 14:
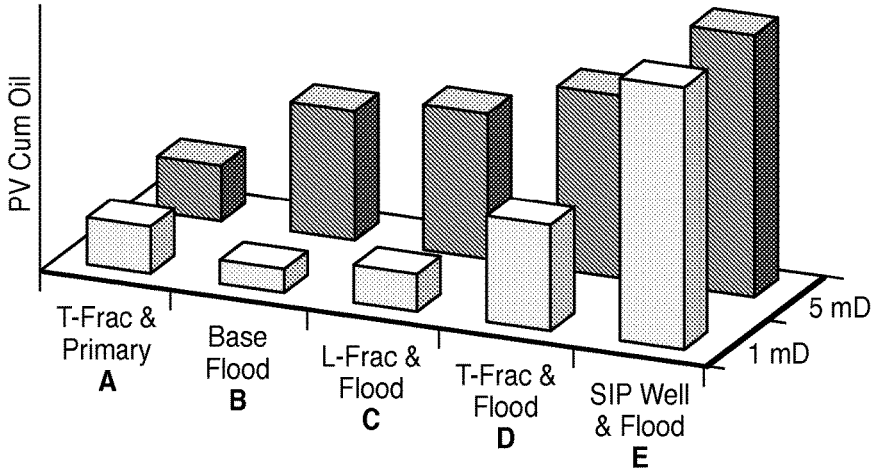
FIG. 14 is a chart comparing recovery rates for different recovery methods.
Figure 15:
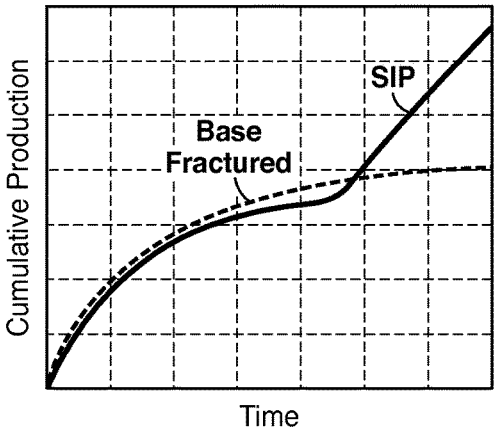
FIG. 15 is a chart comparing cumulative production of hydrocarbons over time for the present disclosure to that of merely using fracturing during primary production.
Figure 16:
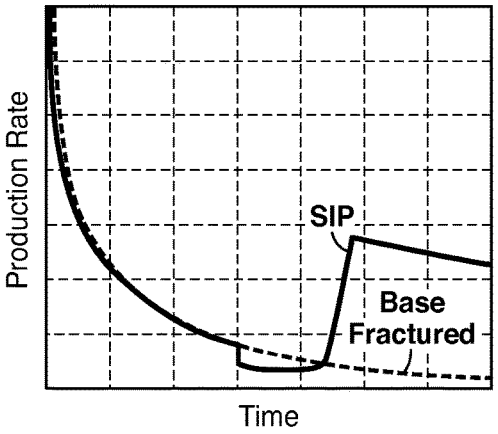
FIG. 16 is a chart comparing the recovery rate of hydrocarbons over time for the present disclosure to that of merely using fracturing during primary production.

As shown in FIGS. 14-16, the system and method recovers substantially more hydrocarbons than those conventionally recovered. FIG. 14 shows the present value cumulative hydrocarbon recovery from two homogenous models with a permeability of 5 mD and 1 mD for five different recovery methods. The recovery methods include transverse fracturing and primary production A, water-flooding B, longitudinal fracturing and water-flooding C, transverse fracturing and water-flooding D, and the system and method E. As depicted in FIG. 14, the system and method E recovers substantially more hydrocarbons than recovery methods A-D.

FIGS. 15-16 show preliminary reservoir simulation results that compare the system to a conventional, fractured well assuming that each fracture is spaced 100 m from the adjacent fracture and the permeability of the formation is 1 mD. The system is assumed to be cumulatively produced by only fracturing during primary production for 1500 days and then converted to simultaneously injecting the fluid and producing hydrocarbons. As can be seen in FIG. 15, the cumulative production for the system is significantly higher than fracturing during primary production. As can be seen in FIG. 16, the system achieves significant increase in hydrocarbon rate after it is converted from the hydrocarbons being produced by fracturing during primary production to simultaneously injecting the fluid and producing the hydrocarbons. Although FIGS. 15-16 show the conversion at 1500 days, the conversion could occur at any time. If the conversion occurs earlier, such as at 300 days, the enhanced performance of the simultaneously injected fluid and produced hydrocarbons would occur earlier. If the conversion occurs later, the enhanced performance of the simultaneously injected fluid and produced hydrocarbons would occur later.

The system and method also significantly reduces a distance that the fluid injected into the wellbore has to travel before hydrocarbons are produced. Reducing the distance can improve the economics of injecting the fluid. The economics of injecting the fluid are frequently challenged in conventional systems because there is a significant time lag between when the fluid is injected and when production occurs. Because the system reduces the displacement distance between one well to another to the spacing between the first fracture 52 and the second fracture 53, the lag between the injection of the fluid and the production of the hydrocarbons can be reduced to a point where injection of the fluid and production of the hydrocarbons occurs simultaneously.

This acceleration of production can be beneficial to the economics of enhanced hydrocarbon recovery methods such as surfactant injection, miscible gas injection, etc. The cost of enhanced hydrocarbon recovery injectants is relatively high compared to water. By accelerating incremental production resulting from displacing hydrocarbons with an enhanced hydrocarbon recovery injectant, the simultaneous injection-production well can improve the economics of enhanced hydrocarbon recovery processes.

To mitigate fracture intersection and thereby mitigate short-circuiting, careful selection of the field, well orientation and/or spacing between the fractures can be implemented. To help carefully select the field, well orientation and/or spacing between the fractures, the method may include at least one of (a) at least one of logging the formation while drilling the wellbore, (b) at least one of monitoring and analyzing at least one of pressures and flow rates, (c) well testing after forming at least one of the first fracture and the second fracture, and (d) monitoring pressures in adjacent wells. The at least one of logging the formation while drilling the wellbore may include logging to obtain wellbore data and analyzing the wellbore data to assist in forming the first fracture and the second fracture. The at least one of monitoring and analyzing at least one of pressures and flow rates may include at least one of monitoring and analyzing while forming at least one of the first fracture and the second fracture. The well testing after forming at least one of the first fracture and the second fracture may include well testing to assess the effective fracture lengths. The monitoring pressures in adjacent wells may include monitoring while forming at least one of the first fracture and the second fracture.

Log data can be used to design the fracture spacing to reduce the risk of fracture intersection while still maintaining good well performance. The planned fracture spacing for the well can be adjusted based on reservoir quality as estimated from porosity or resistivity logs. The usual well plan will normally have a consistent spacing of fractures along the well, but it is possible to adjust fracture spacing or the planned location of fractures if the logs showed substantial reservoir quality variations along the wellbore.

In order to optimize simultaneous injection-production well performance, the completion design may include determining which fractures should receive injectant, which fractures should be produced and which fractures should be isolated from injection or production. Although in the ideal scenario hydraulic fractures would be largely perpendicular to the well as well as uniform in spacing, size and fracture conductivity, in reality many fracturing techniques result in quality and production variations between fractures. For example, after a hydraulic fracture stimulation job, some zones may lack extensive fracturing while other zones may be extensively fractured. An additional complication is that fractures may extend between adjacent wells and intersect both wells.

The determining which fractures should receive injectant and which fractures should be produced may include measuring and/or analyzing the production and/or injection performance potential of the fractures and installing completions based on the measurements. The measuring and/or analyzing the production and/or injection performance potential of the fractures may include measuring or collecting pressure, temperature, flow rate, or micro-seismic data. These data may be acquired by running gauges or logs temporarily into the wellbore or from fixed sensors or gauges. Also, different tracers can be included with proppant for each frac stage and produced fluids analyzed for relative tracer concentrations. In addition, data obtained while drilling the wellbore or when creating the fractures may be used.

Further, optimizing the performance of simultaneous injection-production wells may also include effectively distributing injection and production between the fractures. Simultaneous injection-production well performance can be optimized by identifying which fractures should have their flow rate restricted in order to more optimally distribute injectant or production between multiple fractures. An understanding of the hydraulically induced fracture distribution, hydraulic fracture properties and flow behavior coupled with the ability to design the placement of the injection and production zones may improve the potential performance and economics of the simultaneous injection-production well.

Figure 19:
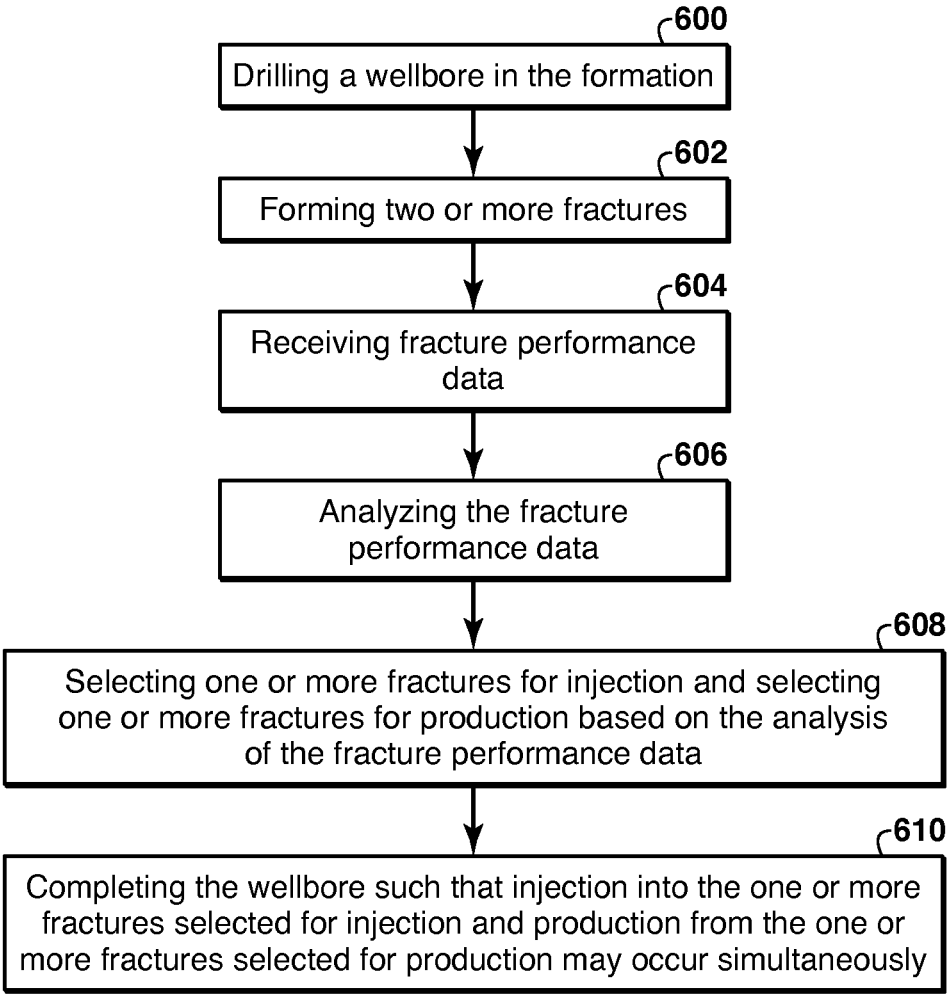
FIG. 19 is a schematic of a method of producing hydrocarbons from a formation.

Referring to FIG. 19, a method of producing hydrocarbons from a formation may include drilling a wellbore in the formation 600, forming two or more fractures in the formation from the wellbore 602, receiving fracture performance data about the two or more fractures 604, analyzing the fracture performance data 606, selecting one or more fractures for injection and selecting one or more fractures for production 608 based on the analysis of the fracture performance data 606, completing the wellbore such that injection into the one or more fractures selected for injection and production from the one or more fractures selected for production may occur simultaneously 610.

Receiving fracture performance data about the two or more fractures 604 may include collecting pressure, temperature, flow rate, tracer concentration, seismic data, or other surveillance data during or after the creation of the fractures. For example, the technique of real-time micro-seismic may be sufficient to identify where the fractures are, their approximately length, and whether the fractures are approaching one another. Using micro-seismic or another technique, if, for example, it is determined that a hydraulic fracture is propagating toward an adjacent fracture, the pumping can be halted. Use of seismic data or micro-seismic data may include drilling an offset well and providing seismic recording devices in the offset well to obtain seismic data for the two or more fractures. Other techniques for estimating fracture geometry may be developed and applied in the future.

Analyzing the fracture performance data 604 can be performed during or after the forming two or more fractures in the formation from the wellbore 602 (stimulation job). During the stimulation job, measurements of fluid volumes injected as well as injection pressures may be used with developed correlations to assess which fractures were stimulated more effectively. After the stimulation job, several techniques are available to assess individual fracture performance. Examples of methods to acquire data to assess fracture performance include, but are not limited to: running production logging tools to measure pressures, temperatures and/or flow rates; installing fixed sensors, such as distributed temperature sensors; and including different tracers with proppant for each fracture stage and analyzing production data for relative tracer concentrations.

Selecting one or more fractures for injection and selecting one or more fractures for production 606 based on the analysis of the fracture performance data 604 would typically include alternating injection and production fractures, however, if two fractures are potentially intersecting or if a fracture had poor conductivity with the reservoir, it may be decided to group a set of fractures together for either production or injection. Alternatively, it may be decided to not inject or produce from a given fracture set. If a fracture extends from one well to an adjacent well or intersects a fracture from an adjacent well, one might choose to complete that same fracture or the intersecting fractures as production (or alternatively injection) fractures in both wells. Gathering data, such as micro-seismic, to evaluate fracture location and/or pressure, temperature, flow rate, or tracer data to evaluate fracture effectiveness can be used to determine the optimal allocation of injection and production between fractures. Using this information, completions can be designed to isolate desired fractures for injection and desired fractures for production.

Selecting one or more fractures for injection and selecting one or more fractures for production 606 based on the analysis of the fracture performance data 604 may also include controlling production and injection along the length of the completion to more optimally distribute injection and production between multiple fractures. Injection and production may be approximately balanced across each fracture to improve recovery. Information on pressures and flow rates can be used to size or adjust inflow control devices, outflow control devices, limited entry techniques, or other flow control equipment incorporated into the completion equipment to improve flow distribution.

Data to help optimize the completion may be gathered at the time the wells are drilled and fractured. However, there can be ample opportunity to obtain data on fracture effectiveness before the simultaneous injection-production well completion is installed. For the simultaneous injection-production well, the leading initial operational strategy is to produce under primary depletion until the well rate has declined substantially from the peak well rate before injection begins. If the simultaneous injection-production completion is installed after the period of primary depletion, surveillance data acquired during the primary production phase can be used to assess the effectiveness of fractures and optimize the simultaneous injection-production completion before it is installed.

Even after the simultaneous injection-production completion has been installed, tracers or production logs may be used to assess whether modifications should be made to the completion to optimize well performance. For example, if early water breakthrough occurs, production logs measuring temperature, flow rate, capacitance, fluid density and/or other parameters can be used to determine which fractures are having communication challenges, and simple workovers may be used to plug (cement) a problematic injection zone, or as an alternative, sliding sleeves on the injection perforations may be used to prevent injection into a compromised zone. This is a key advantage of the simultaneous injection-production well over competing technologies since individual fracture zones can be isolated and shut-off as opposed to losing an entire well.

Analyzing wellbore and monitoring data may include assessing where fractures spread, determining the anisotropy in the horizontal stresses in the formation, first fracture, and/or second fracture, etc. After the wellbore data is analyzed, information such as the stress state, location of the axis of the wellbore and/or the minimum in-situ horizontal stress could be used to mitigate the risk of fracture intersection. For example, the stress state could be leveraged and the axis of the wellbore could be aligned with the minimum in-situ horizontal stress to mitigate the risk of fracture intersection since fractures tend to open against a minimum in-situ stress and tend to propagate in a directional fashion in reservoirs with strong anisotropy in the horizontal stresses.

Fractures may tend to propagate preferably more to one side of a well (i.e. North) rather than the other direction (i.e. South), which may need to be accounted for in the design. Increasing fracture spacing may reduce the risk of fracture intersection. Fractures may be spaced at intervals as close as 25 m and as much as 300 m. For example, the fractures may be between 10 and 200 m apart and 25 and 100 m apart. The design of fracture spacing will depend on the permeability of the formation, reservoir heterogeneities, completion costs, risk of fracture intersection, and other factors. Identifying whether at least one of the fractures is at least 50 m long (i.e., the end of the fracture that emanates from the wellbore is at least 50 m from the other end of the fracture where the fracture has two ends) may also reduce the risk of fracture intersection. Fracture half length (i.e. the distance from the furthest end of the fracture and the wellbore) may also affect the risk of fracture intersection. Fracture half lengths may range from 50 m to more than 200 m. Longer fracture half lengths may increase recovery but also increase the risk of fracture intersection.

During the stimulation job to create the fractures, measurements of fluid volumes injected as well as injection pressures may be used with developed correlations to assess the likely fracture dimensions. Careful monitoring of injection fluid volumes and injection pressures during the stimulation job to create a fracture may be used to evaluate whether the new fracture may be at risk of intersecting other fractures and to change or curtail the injection that is creating the fracture.

Analyzing the fracture data may include reviewing the data to assess whether the first and/or second fractures are having communication challenges and to identify what zone (i.e., production or injection) the fracture is in. After simultaneous injection and production begin, early production of water can indicate whether fractures are intersecting. Production logging tools that measure pressures, temperatures, flow rates, fluid capacitance, fluid density, water-hydrocarbon fractions and/or fluid properties along the wellbore can be used to identify which production fractures in the wellbore may be communicating with an injection fracture. An alternative way of identifying which production fractures might be in communication with injection fractures is to monitor data from fixed sensors that have been installed as part of the completion, such as a fiber optic cable used as a distributed temperature sensor. Another way of identifying which production fractures might be in communication with injection fractures is to include different tracers with proppant for each fracture and analyzing produced fluids for relative tracer concentrations If one or more of the fractures is having communication challenges, workovers may be implemented to plug a problematic injection zone. Or a flow control device that can enclose the opening in the injection tubing string may be used to prevent injection of the fluid into the problematic zone. While some of these ways to identify are discussed as being alternatives to one another, one or more of the ways may be implemented in the system.

To mitigate fracture intersection, the method may also include monitoring the forming of each fracture and/or creating clusters of tightly spaced fractures with larger spaced buffers between the clusters. To increase the likelihood that the fractures do not intersect, the fractures may be formed concurrently so that the formed fractures shield one another, thereby preventing fracture intersection. Concurrent fracturing decreases the likelihood that the fractures do not intersect.

Moreover, to mitigate fracture intersection, the method may also include monitoring at least one of the first fracture and the second fracture during or after at least one of forming the first fracture and forming the second fracture. The monitoring may be performed using any suitable method, such as microseismic methods. The data obtained while monitoring may be analyzed and/or evaluated to identify whether fractures are approaching one another. If the data indicates that fractures are approaching one another, the method may also include ceasing formation of a fracture or plugging of a fracture. A fracture may be plugged by injecting a plugging agent into the formation or a casing and/or liner patch may be used, such as those discussed in paragraph [0062] of this disclosure.

To analyze at least one of the fluid and hydrocarbons flowing one of in, out and along the wellbore, the system and method may include analyzing a production log. The production log may include any suitable production log. For example, the production log may measure pressure, temperature, flow rate, fluid capacitance, fluid density, or other fluid properties along the wellbore. Analyzing of the production log may be used to analyze directly or indirectly the fluid and/or hydrocarbons flowing in, out and/or along the wellbore. As an alternative or complement to production logs, the system and method may include at least one of the use of (a) fixed sensors that have been installed as part of the completion, such as a fiber optic cable used as a distributed temperature sensor and (b) different tracers with proppant for each fracture and the analysis of produced fluids for relative tracer concentrations.

Information on fluid flowing one of in, out and along the wellbore, from production logs, tracer analysis or other measurements can be obtained after fractures are created in the wellbore during primary production and/or before the completion equipment enabling simultaneous injection and production is installed in the well. The information on flow performance along the wellbore can be used to help design holes, orifices, or other sorts of inflow control devices or outflow control devices that may be installed as part of the completion equipment enabling simultaneous injection and production in the well. These inflow control devices and outflow control devices, such as flow control device 163, 263 (FIG. 4) can be used to restrict flow between the well and the formation. Adjusting these devices so that flow is more evenly distributed along the wellbore can be used to optimize the recovery of hydrocarbons during simultaneous injection and production.

Additionally, the method may include logging the formation at least one of prior to fracturing and installing completion equipment. Open hole or cased hole logs could be used to log the formation. Completion equipment may include any suitable completion element, such as a packer, adjustment element, liner patch, casing, cement, etc. Logging the formation before fracturing and/or installing completion equipment may an operator or a computer identify areas of the reservoir, which is within the formation, that are best suited or worst suited for simultaneous injection and production. For example, some logging while drilling may help identify the likely near-wellbore orientation of natural fractures in the formation based at least on breakouts and other data. And other logging while drilling may help identify regions of natural fractures in the formation. These regions of natural fractures may short-circuit the simultaneous injection and production process by allowing fractures to intersect and thereby prevent the pressure difference needed to cause the first fracture to produce hydrocarbons. Consequently, identifying where natural fractures may or may not occur may be an indicator that fracturing should not take place in the region where natural fractures may occur where completion equipment can be placed to separate the fractures formed.

Additionally, the method may include logging the formation after installation of completion equipment. Logging the formation with cased hole logs or production logs after installation of completion equipment could help an operator or computer identify channels in the cement or completion equipment that could cause short circuiting during simultaneous injection and production process.

A method of producing hydrocarbons from a formation may include drilling a first wellbore 154 in a formation 400, forming a first fracture 152 in the formation that emanates from the first wellbore 154, 401, forming a second fracture 273 in the formation that emanates from the first wellbore 154, 402 sealing an opening to one of the first fracture 152 and the second fracture 273, 403, drilling a second wellbore 255, 404 and simultaneously (a) injecting a fluid, that increases pressure in an area of the formation adjacent to the first fracture 152, from the second wellbore 255 to the second fracture 273 and (b) producing hydrocarbons that travel from the first fracture 152 into the first wellbore 154, 405 (FIGS. 7-11 and 17). While the injection and production generally occur simultaneously, there may be instances where they do not occur simultaneously. Injection and production may not occur simultaneously to manage excessive communication between the injection tubing string, the production tubing string, the first fracture, and/or the second fracture.

The first wellbore 154 may be drilled by any suitable mechanism; the wellbore 154 may be approximately horizontal when the wellbore 154 is drilled. Specifically, the orientation of the wellbore 154 may be approximately parallel relative to the Earth's surface. The longitudinal axis 153-153 (FIG. 7) of the first wellbore 154 may be approximately parallel to the lateral axis. The longitudinal axis 153-153 may be approximately transverse to the longitudinal axis of the Earth. The approximately horizontal wellbore may be a wellbore that is at a high angle or a dipping angle, but not completely horizontal, or a wellbore that is substantially horizontal.

The formation may be a low-permeability formation or a high-permeability formation. Practically speaking, low-permeability formations may be formations where near approximately horizontal wells are employed with multiple fracture stimulations distributed along the well and required to produce fluids from the formation at economic rates. For example, a low-permeability formation may be less than or equal to 10's of mD, 10's of mD on average, 10 mD, or 10 mD on average. Low-permeability formations may have some high permeability streaks and high-permeability formations may have some low permeability streaks.

The permeability of a formation may be measured by any suitable method. For example, the permeability may be measured or determined from core tests or well tests. The average permeability of a formation may be based on a thickness-weighted arithmetic average of measured or estimated permeabilities within the formation, or it may be based on well test measurements. Furthermore, it is recognized that permeability can vary greatly from place to place within a given reservoir and there may not be consistency between different measures of permeability.

The first fracture 152 is in the formation and emanates from the first wellbore 154. The first fracture 152 is formed by any suitable type of fracturing. For example, the first fracture 152 may be formed by a hydraulic fracturing treatment with or without proppant, or with acid injection. The first fracture 152 may be any suitable size. The first fracture 512 may receive hydrocarbons from a reservoir in the formation.

The first fracture 152 is constructed and arranged to receive hydrocarbons when the second fracture 273 receives a fluid injected into the second wellbore 255. In other words, the first fracture 152 is sized and located to receive hydrocarbons from a reservoir in the formation. The first fracture 152 is in fluid communication with the first wellbore 154 so that the first wellbore 154 can receive the produced hydrocarbons that the first fracture 152 receives and, therefore, produces.

The fluid injected into the second wellbore 255 may be any suitable fluid. For example, the fluid may comprise at least one of water, a hydrocarbon gas, a non-condensable gas, surfactants, foaming agents, polymers, and solids. If the fluid comprises a gas, the gas may be a miscible gas. The water may comprise any type/form of water. For example, the water may comprise at least one of modified brine, hot water, cold water and steam. The non-condensable gas may comprise any type of non-condensable gas. For example, the non-condensable gas may comprise at least one of carbon dioxide, methane, ethane, propane, and nitrogen gas.

Before or after injecting the fluid into the second wellbore 255, a plugging agent may be injected into the second wellbore to promote diversion of the fluid away from any high-permeability streaks in a low-permeability formation, any low-permeability streaks in a high-permeability formation, and/or other short-circuit paths so better displacement is obtained. The plugging agent may be any suitable plugging agent, such as at least one of cement, polymer, foam, gel, or gel forming chemical. The gel forming chemical may be any suitable chemical, such as at least one of sodium silicate solution, solid, or salt. The plugging agent may be injected into at least one of the first fracture 152 and the second fracture 273.

A casing and/or liner patch may be installed in the wellbore. The casing and/or liner patch promotes diversion of the fluid away from any section of the wellbore that is connected to the reservoir to block flow into regions of the reservoir having high-permeability paths and/or other short-circuit paths so better displacement is obtained elsewhere in the reservoir. When the casing and/or liner patch is installed into the second wellbore 255, it may be installed into at least one of the first fracture 152 and the second fracture 273. Alternatively or in addition, the casing or liner patch may be installed into the second wellbore 255 after a period of operation and/or a production log identifying excessive flow.

The second fracture 273 is in the formation and emanates from the first wellbore 154. The second fracture 273 is formed by any suitable type of fracturing. For example, the second fracture 273 may be formed by a hydraulic fracturing treatment with or without proppant or with acid injection. The second fracture 273 may be any suitable size. The second fracture 273 may comprise an injection fracture that receives the fluid.

The second fracture 273 is constructed and arranged to receive the fluid injected into the second wellbore 255 that increases pressure in the formation in an area adjacent to the first fracture 152. In other words, the second fracture 273 is sized to receive the fluid and is in fluid communication with the second wellbore 255 so that the second fracture 273 can receive the fluid that is injected into the second wellbore 255.

When the fluid injected into the second fracture 273 increases pressure in the formation in an area adjacent to the first fracture 152, hydrocarbons are displaced from the first fracture 152 and are produced by the first fracture 152. In other words, when the fluid injected into the second fracture 153 increases pressure, the hydrocarbons travel into the first fracture 152 and from the first fracture 152 into the first wellbore 154. The hydrocarbons are displaced in-part because the injection of the fluid creates a pressure difference between the area surrounding the first fracture and the area surrounding the second fracture that leads to hydrocarbons entering the first fracture. The hydrocarbons are also displaced because the first fracture and the second fracture do not intersect. If the first fracture intersects the second fracture, the efficiency of the process is reduced due to the high permeability pathway that results allowing the injected fluids to flow directly to the first fracture without sweeping the targeted hydrocarbons in the reservoir. Provided that the locations of the fractures is controlled such that the fractures are initiated at spacings of 10's of meters or more along the well, the fractures would not be expected to intersect.

The first fracture 152 may comprise a plurality of first fractures and the second fracture 273 may comprise a plurality of second fractures. Each of the plurality of first fractures may be directly adjacent to one of the plurality of second fractures so that the first and second fractures alternate along a length of the wellbore. Each first fracture 152 may be about 25 to 300 m, such as between 100 to 200 m, from each second fracture 273. This spacing between the first fracture 152 and the second fracture 153 may depend on the permeability of the formation, formation heterogeneities, completion costs, risk of fracture intersection, etc. Each first fracture 52 may not be used for production. Each second fracture 53 may not be used for injection. Alternatively, some of the plurality of first fractures may be directly adjacent to each other to form a first fracture group and some of the plurality of second fractures may be directly adjacent to each other to form a second fracture group. Each fracture may be about 25 m to 300 m apart, such as between 100 and 200 m apart. The first fracture group may be directly adjacent to a second fracture group. There may be a plurality of first and/or second fracture groups. Not all of the first and/or second fracture groups may be used for production and injection, respectively.

The first fracture 152 and the second fracture 273 may extend from the first wellbore 154 for any suitable distance. For example, the first fracture 152 and the second fracture 273 may extend from the first wellbore 154 for 20 to 500 m or 100 to 300 m.

At least one of the first fracture 152 and the second fracture 273 may comprise one of a propped fracture, an unpropped fracture and an acid fracture. When the first and/or second fracture 152, 273 comprise a propped fracture, the first and/or second fracture 152, 273 include a material that props the fracture 152, 273 open during and after fracturing so that a fluid path between the fracture 152, 273 and at least one of the first wellbore and the second wellbore remain open. The material may comprise sized particles that are mixed with the fluid used to create the fracture 152, 273. The sized particles may include sand grains, proppants or any other suitable sized particles. When the first and/or second fractures 152/273 comprise an unpropped fracture, the first and/or second fractures 152/273 remain propped because of the natural properties of the formation after fracturing. When the first and/or second fracture 152, 273 comprise an acid fracture, the first and/or second fracture 152, 273 may be fractured with an acid. The acid may be any suitable acid, such as a hydrochloric acid. The acid fracture may be used in carbonate formations where it's practical to dissolve the rock in the formation with an acid. Propped fractures may be applied in most types of reservoirs, including both carbonate and clastics (e.g. sandstone, shale).

The injected fluid may enter the reservoir at a high enough pressure to hydraulically fracture the reservoir during the process of fluid injection and production. In this mode of operation one may not have performed a fracture treatment of any form previously discussed.

The first fracture 152 may comprise one type of fracture, such as a hydraulic fracture, and the second fracture 273 may comprise another type of fracture, such as an acid fracture. When the fractures comprise different types of fractures, one type of fracture may have to be produced at a first time and the other type of fracture may have to be produced at a second time that is different from the first time. For example, the first fracture 152 may have to be produced at the first time and the second fracture 273 may have to be produced at the second time. Alternatively, the different types of fractures may be produced at the same time.

Figure 10:
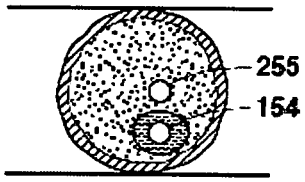
FIG. 10 is an end, schematic view of FIG. 9.
Figure 11:
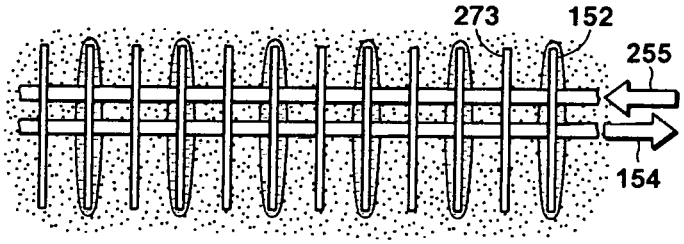
FIG. 11 is top, schematic view of FIG. 9 during injection of a fluid and production of the hydrocarbons.

The second fracture 273 may be substantially parallel to the first fracture 152. Specifically, a longitudinal axis 172-172 of the first fracture 152 may be substantially parallel to a longitudinal axis 173-173 of the second fracture 273. Moreover, the first fracture longitudinal axis 172-172 of the first fracture 152 and the second fracture longitudinal axis 173-173 of the second fracture 273 may be substantially transverse to at least one of a first wellbore longitudinal axis 153-153 of the first wellbore 154 and a second wellbore longitudinal axis 253-253 of the second wellbore 255 (FIG. 10). In other words, at least one of first fracture 152 and the second fracture 273 may be substantially oblique and irregular with respect to the first wellbore 154 and the second wellbore 255.

A sealing element 159 (FIG. 8) may be used to seal an opening to one of the first fracture 152 and the second fracture 273. The sealing element 159 may comprise any suitable element that mechanically or chemically seals. For example, the sealing element 159 may comprise at least one of a casing, liner patch, cement squeeze and sliding sleeve. The sealing of the first fracture 152 or the second fracture 273 may occur after the first wellbore 154 is drilled and/or after the first and second fractures are formed. When the sealing occurs after the sealing and drilling, primary production of the formation can occur before sealing.

After sealing the one of the first fracture and the second fracture 152, 273, the method may include drilling the second wellbore 255 in the formation that is approximately horizontal and substantially parallel to the first wellbore 154. Once drilled, the second wellbore 255 may be within 0.5-15 meters of the first wellbore 154. For example, the second wellbore 255 may be within 3-15 meters of the first wellbore 154. The approximately horizontal second wellbore may be a wellbore that is at a high angle or a dipping angle, but not completely horizontal, or a wellbore that is substantially horizontal.

The second wellbore 255 may be approximately horizontal when the second wellbore is drilled. The orientation of the second wellbore 255 may be approximately parallel relative to the Earth's surface. The longitudinal axis 253-253 (FIG. 9) of the second wellbore 255 may be approximately parallel to the lateral axis of the Earth and approximately transverse to the longitudinal axis of the Earth. The second wellbore 255 is drilled after sealing one of the first fracture 152 and the second fracture 273 to prevent commingling of fluids or hydrocarbons when the second wellbore 255 is drilled.

The second wellbore 255 may intersect at least one of the first fracture 152 and the second fracture 273. To ensure that the second wellbore 255 intersects at least one of the first fracture 152 and the second fracture 273, the first wellbore 154 and the second wellbore 255 may be about 0.5 to 15 m apart.

After at least one of sealing the opening and drilling the second wellbore 255, the second wellbore 255 may be at least one of perforated, acidized and fractured to establish a continuous fluid pathway between the second wellbore 255 and the second fracture 273. As a result, the second fracture 273 can receive the fluid injected into the second wellbore 255.

The method may include simultaneously injecting the fluid and producing the hydrocarbons. The simultaneous injection and production may occur after sealing. This may also occur after perforating, acidizing or fracturing. The simultaneous injection and production is similar to that of FIGS. 4-6, but involves two wellbores instead of a single wellbore. The method of simultaneous injecting and producing with two wellbores instead of a single wellbore may use simpler completion technology than the single wellbore (e.g., the two wellbores may not require sliding sleeves and/or packers) but the two wellbores may be more costly to drill than the single wellbore. Moreover, like the system and method discussed with respect to FIGS. 4-6, before simultaneously injecting and producing, hydrocarbons may be produced from at least one of the first fracture 152 and the second fracture 273.

Figure 12:
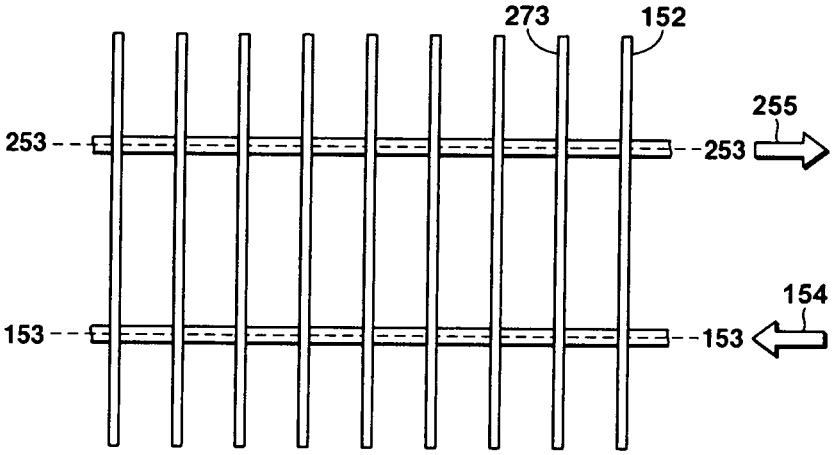
FIG. 12 is a top, schematic of a first well and a second well.
Figure 17:
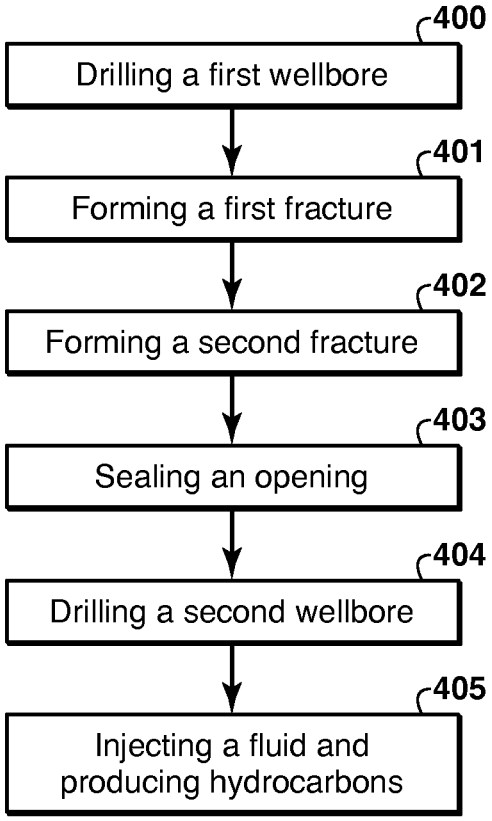
FIG. 17 is a schematic of a method of producing hydrocarbons from a formation.
Figure 18:
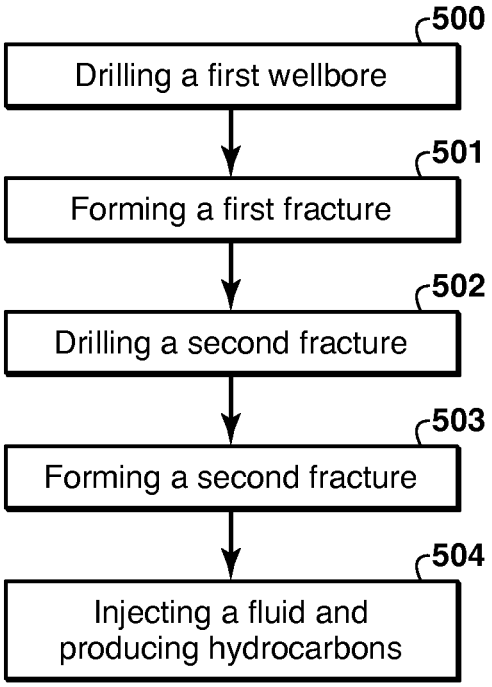
FIG. 18 is a schematic of a method of producing hydrocarbons from a formation.

A method of producing hydrocarbons from a formation may include drilling the first wellbore 154 in the formation 500, forming the first fracture 152 in the formation that emanates from the first wellbore 154, 501, drilling the second wellbore 255 in the formation that is approximately horizontal and substantially parallel to the first wellbore 154, 502, forming the second fracture 273 in the formation that emanates from the second wellbore 155 and is substantially parallel to the first fracture 152, 503, and simultaneously (a) injecting the fluid, that increases pressure in an area of the formation adjacent to the first fracture 152, from the second wellbore 255 to the second fracture 273 and (b) producing hydrocarbons that travel from the first fracture 152 into the first wellbore 154, 504 (FIGS. 12 and 18). This method of producing hydrocarbons from a formation contains many of the same elements as the method of producing hydrocarbons from a formation for FIGS. 7-11 and 17. Consequently, many of the steps and elements described in the method associated with FIGS. 7-11 and 17 are relevant to the method associated with FIGS. 12 and 18 and are not again discussed.

One of the main differences between the method associated with FIGS. 7-11 and 17, and the method associated with FIGS. 12 and 18 is that the first fracture 152 of FIG. 12 intersects the second wellbore 255 and the second fracture 273 of FIGS. 12 and 19 intersects the first wellbore 154. Another main difference is that the method of FIGS. 12 and 18 does not require sealing an opening to one of the first fracture and the second fracture with a sealing element. Yet, another difference is that the first wellbore 154 and the second wellbore 255 may be drilled at the same time for the method associated with FIGS. 12 and 18. Another difference is that the first wellbore 154 may be 3-25 meters from the second wellbore 255.

The methods associated with FIGS. 7-12 and 17-18 are different from conventional water-flooding and gas-flooding because flooding occurs between adjacent fractures rather than between adjacent wells. Each well is connected to alternating sets of fractures. Rather than dividing production and injection between two parts of a single completion string, production and reinjection are divided between two separate wellbores. The methods associated with FIGS. 7-12 and 17-18 are also different from conventional water-flooding and gas-flooding because the arrangement of the fractures (e.g., spacing, forming) prevents undesired fracture intersection. The arrangement of the wellbores with respect to each other (e.g., spacing, forming) is also different).

Like the single wellbores of FIGS. 4-6, either of the two wellbore systems (i.e., the first two wellbore system shown in FIGS. 7-11 and the second two wellbore system shown in FIG. 12) may include using one or more of the techniques disclosed in paragraphs [0090]-[00102]. Additionally, like the single wellbores of FIGS. 4-6, the improved reservoir simulation results shown in FIGS. 15-16 are also expected for the two wellbore systems of FIGS. 7-12.

Persons skilled in the technical field will readily recognize that in practical applications of the disclosed methodologies, one or more steps may be performed on a computer, typically a suitably programmed digital computer. Further, some portions of the detailed descriptions have been presented in terms of procedures, steps, logic blocks, processing and other symbolic representations of operations on data bits within a computer memory. These descriptions and representations are the means used by those skilled in the data processing arts to most effectively convey the substance of their work to others skilled in the art. In the present application, a procedure, step, logic block, process, or the like, is conceived to be a self-consistent sequence of steps or instructions leading to a desired result. The steps are those requiring physical manipulations of physical quantities. Usually, although not necessarily, these quantities take the form of electrical or magnetic signals capable of being stored, transferred, combined, compared, and otherwise manipulated in a computer system.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present application, discussions utilizing the terms such as "analyzing,", "identifying," "monitoring," "processing" or "computing," "calculating," "determining,"

"displaying," "copying," "producing," "storing," "accumulating," "adding," "applying," "identifying," "consolidating," "waiting," "including," "executing," "maintaining," "updating," "creating," "implementing," "generating" or the like, may refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

It is important to note that the steps depicted in FIGS. 13 and 17-18 are provided for illustrative purposes only and a particular step may not be required to perform the inventive methodology. The claims, and only the claims, define the inventive system and methodology.

Embodiments of the present disclosure may also relate to an apparatus for performing some of the operations herein. This apparatus may be specially constructed for the required purposes, or it may comprise a general-purpose computer selectively activated or reconfigured by a computer program stored in the computer. Such a computer program may be stored in a computer readable medium. A computer-readable medium includes any mechanism for storing or transmitting information in a form readable by a machine (e.g., a computer). For example, but not limited to, a computer-readable (e.g., machine-readable) medium includes a machine (e.g., a computer) readable storage medium (e.g., read only memory ("ROM"), random access memory ("RAM"), magnetic disk storage media, optical storage media, flash memory devices, etc.), and a machine (e.g., computer) readable transmission medium (electrical, optical, acoustical or other form of propagated signals (e.g., carrier waves, infrared signals, digital signals, etc.). The computer-readable medium may be non-transitory.

Furthermore, as will be apparent to one of ordinary skill in the relevant art, the modules, features, attributes, methodologies, and other aspects of the disclosure can be implemented as software, hardware, firmware or any combination of the three. Of course, wherever a component of the present disclosure is implemented as software, the component can be implemented as a standalone program, as part of a larger program, as a plurality of separate programs, as a statically or dynamically linked library, as a kernel loadable module, as a device driver, and/or in every and any other way known now or in the future to those of skill in the art of computer programming. Additionally, the present disclosure is in no way limited to implementation in any specific operating system or environment.

As indicated disclosed aspects may be used to produce hydrocarbons. Disclosed aspects may also be used in other hydrocarbon management activities, in addition to hydrocarbon production. As used herein, "hydrocarbon management" or "managing hydrocarbons" includes hydrocarbon extraction, hydrocarbon production, hydrocarbon exploration, identifying potential hydrocarbon resources, identifying well locations, determining well injection and/or extraction rates, identifying reservoir connectivity, acquiring, disposing of and/or abandoning hydrocarbon resources, reviewing prior hydrocarbon management decisions, and any other hydrocarbon-related acts or activities. The term "hydrocarbon management" is also used for the injection or storage of hydrocarbons or $CO_2$, for example the sequestration of $CO_2$, such as reservoir evaluation, development planning, and reservoir management. Other hydrocarbon management activities may be performed according to known principles.

The following lettered paragraphs represent non-exclusive ways of describing embodiments of the present disclosure.

1. A method of producing hydrocarbons from a formation, the method comprising:
(a) drilling a wellbore in the formation, wherein the wellbore is approximately horizontal;
(b) forming two or more fractures in the formation from the wellbore;
(c) receiving fracture performance data about the two or more fractures;
(d) analyzing the fracture performance data;
(e) selecting one or more fractures for injection and selecting one or more fractures for production based on the analysis of the fracture performance data;
(f) completing the wellbore such that injection into the one or more fractures selected for injection and production from the one or more fractures selected for production may occur simultaneously.
2. The method of paragraph 1, wherein the receiving fracture performance data further comprises collecting pressure, temperature, flow rate, or other surveillance data during or after the forming of the fractures.
3. The method of paragraphs 1 or 2, wherein the receiving fracture performance data further comprises providing different tracers with proppant for each fracture stage and analyzing production data for relative tracer concentrations.
4. The method of any of the preceding paragraphs, wherein the receiving fracture performance data further comprises collecting seismic data during or after the forming of the fractures.
3. The method of any of the preceding paragraphs, wherein the analyzing fracture performance data further comprises measuring fluid volumes injected during the formation of the fractures.
4. The method of any of the preceding paragraphs, further comprising receiving data obtained while drilling the wellbore and analyzing the data obtained while drilling the wellbore to plan the location of the two or more fractures.
5. The method of any of the preceding paragraphs, wherein receiving fracture performance data about the two or more fractures occurs during the forming two or more fractures in the formation from the wellbore.
6. The method of any of the preceding paragraphs, wherein receiving fracture performance data about the two or more fractures occurs after the forming two or more fractures in the formation from the wellbore.
7. The method of any of the preceding paragraphs, wherein the receiving fracture performance data about the two or more fractures comprises one of running logging tools in and out of the wellbore, sensors that are permanently installed as a part of the well, or a combination thereof
8. The method of any of the preceding paragraphs, further comprising drilling an offset well and providing seismic recording devices in the offset well to obtain seismic data for the two or more fractures.
9. The method of any of the preceding paragraphs, wherein at least 50% of the formation has an effective bulk permeability of less than 10 mD.
10. The method of any of the preceding paragraphs, wherein completing the wellbore such that injection into the one or more fractures selected for injection and production from the one or more fractures selected for production may occur simultaneously comprises the use of variably sized inflow or outflow control devices, sliding sleeves or other such mechanisms for controlling flow.

11. The method of any of the preceding paragraphs, wherein completing the wellbore such that injection into the one or more fractures selected for injection and production from the one or more fractures selected for production may occur simultaneously comprises injecting differing flow rates into two or more fractures selected for injection.
12. The method of any of the preceding paragraphs, further comprising repeating steps (c)-(f) after a period of producing hydrocarbons after completing steps (a) through (f) such that the completion is further optimized.
13. The method of any of the preceding paragraphs, wherein steps (c)-(f) are performed some period after steps (a) and (b).
14. The method of any of the preceding paragraphs, wherein after steps (a) and (b), the wellbore is placed on primary production for a period of time before completing steps (c)-(f).
15. The method of any of the preceding paragraphs, wherein the one or more fractures selected for injection comprises a plurality of injection fractures and the one or more fractures selected for production comprises a plurality of production fractures, and wherein each of the plurality of injection fractures is directly adjacent to one of the plurality of production fractures.
16. The method of any of the preceding paragraphs, wherein at least one of the first fracture and the second fracture comprise one of a propped fracture, an unpropped fracture and an acid fracture.
17. The method of any of the preceding paragraphs, further comprising:

an injection tubing string in communication with the one or more fractures selected for injection;

a production tubing string in communication with the one or more fractures selected for production;

at least one of discontinuously injecting the fluid from the injection tubing string to the second fracture with an injection tubing string flow control device and discontinuously receiving hydrocarbons from the first fracture to the production tubing string with a production tubing string second flow control device.

18. The method of any of the preceding paragraphs, wherein each of the injection tubing string flow control device and the production tubing string flow control device comprises one of a sliding sleeve, a pressure, activated valve, a mechanically activated valve, an electrically activated valve, an inflow control device, an outflow control device, a choke and a limited-entry perforation.
19. The method of any of the preceding paragraphs, further comprising one of injecting a plugging agent, installing a casing, installing a liner patch, and installing cement into at least one of two or more fractures in the formation.

As utilized herein, the terms "approximately," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

It should be understood that the preceding is merely a detailed description of specific embodiments of this disclosure and that numerous changes, modifications, and alternatives to the disclosed embodiments can be made in accordance with the disclosure here without departing from the scope of the disclosure. The preceding description, therefore, is not meant to limit the scope of the disclosure. Rather, the scope of the disclosure is to be determined only by the appended claims and their equivalents. It is also contemplated that structures and features embodied in the present examples may be altered, rearranged, substituted, deleted, duplicated, combined, or added to each other.

The articles "the", "a" and "an" are not necessarily limited to mean only one, but rather may be inclusive and open ended so as to include, optionally, multiple such elements.

The invention claimed is:

1. A method of producing hydrocarbons from a formation, the method comprising:

(a) drilling a wellbore in the formation, wherein the wellbore is approximately horizontal, receiving data obtained while drilling the wellbore, and analyzing the data obtained while drilling the wellbore to plan the location of two or more fractures formed by different types of fracturing methods;
(b) forming the two or more fractures in the formation from the wellbore;
(c) receiving fracture performance data about the two or more fractures;
(d) analyzing the fracture performance data;
(e) selecting one of the two or more fractures for production, and selecting another of the two or more fractures for injection or closing off based on the analysis of the fracture performance data;
(f) completing the wellbore such that injection into the one or more fractures selected for injection and production from the one or more fractures selected for production occurs simultaneously;

wherein completing the wellbore such that injection into the one or more fractures selected for injection and production from the one or more fractures selected for production occurs simultaneously comprises injecting differing flow rates into the two or more fractures selected for injection.

2. The method of claim 1, wherein the receiving fracture performance data further comprises collecting pressure, temperature, flow rate, or other surveillance data during or after the forming of the fractures.

3. The method of claim 1, wherein the receiving fracture performance data further comprises providing different tracers with proppant for each fracture stage and analyzing production data based on the relative tracer concentrations.

4. The method of claim 1, wherein the receiving fracture performance data further comprises collecting seismic data during or after the forming of the fractures.

5. The method of claim 1, wherein the analyzing fracture performance data further comprises measuring fluid volumes injected during the formation of the fractures.

6. The method of claim 1, wherein receiving fracture performance data about the two or more fractures occurs during the forming two or more fractures in the formation from the wellbore.

7. The method of claim 1, wherein receiving fracture performance data about the two or more fractures occurs after the forming two or more fractures in the formation from the wellbore.

8. The method of claim 1, wherein the receiving fracture performance data about the two or more fractures comprises one of running logging tools in and out of the wellbore, sensors that are permanently installed as a part of the well, or a combination thereof.

9. The method of claim 1, further comprising drilling an offset well and providing seismic recording devices in the offset well to obtain seismic data for the two or more fractures.

10. The method of claim 1, wherein at least 50% of the formation has an effective bulk permeability of less than 10 mD.

11. The method of claim 1, wherein completing the wellbore such that injection into the one or more fractures selected for injection and production from the one or more fractures selected for production may occur simultaneously comprises the use of variably sized inflow or outflow control devices.

12. The method of claim 1, further comprising repeating steps (c)-(f) after a period of producing hydrocarbons after completing steps (a) through (f) such that the completion is further optimized.

13. The method of claim 1, wherein steps (c)-(f) are performed some period after steps (a) and (b).

14. The method of claim 1, wherein after steps (a) and (b), the wellbore is placed on primary production for a period of time before completing steps (c)-(f).

15. The method of claim 1, wherein the one or more fractures selected for injection comprises a plurality of injection fractures and the one or more fractures selected for production comprises a plurality of production fractures, and wherein each of the plurality of injection fractures is directly adjacent to one of the plurality of production fractures.

16. The method of claim 15, wherein at least one of the first fracture and the second fracture comprise an acid fracture.

17. The method of claim 1, further comprising:

an injection tubing string in communication with the one or more fractures selected for injection;

a production tubing string in communication with the one or more fractures selected for production;

at least one of discontinuously injecting the fluid from the injection tubing string to the second fracture with an injection tubing string flow control device and discontinuously receiving hydrocarbons from the first fracture to the production tubing string with a production tubing string second flow control device.

18. The method of claim 17, wherein each of the injection tubing string flow control device and the production tubing string flow control device comprises one of a sliding sleeve, a pressure, activated valve, a mechanically activated valve, an electrically activated valve, an inflow control device, an outflow control device, a choke and a limited-entry perforation.

19. The method of claim 1, further comprising one of injecting a plugging agent, installing a liner patch, and installing cement into at least one of the one or more fractures selected for injection and at least one of the one or more fractures selected for production.

* * * * *